US008007977B2

(12) United States Patent
Inoue et al.

(10) Patent No.: US 8,007,977 B2
(45) Date of Patent: Aug. 30, 2011

(54) TONER AND IMAGE FORMING METHOD USING THE TONER

(75) Inventors: Ryota Inoue, Numazu (JP); Sonoh Matsuoka, Numazu (JP); Chiaki Tanaka, Tagata-gun (JP); Naohiro Watanabe, Suntou-gun (JP); Masahide Yamada, Numazu (JP); Masahiro Ohki, Numaz (JP); Akinori Saitoh, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 365 days.

(21) Appl. No.: 11/224,976

(22) Filed: Sep. 14, 2005

(65) Prior Publication Data

US 2006/0057488 A1 Mar. 16, 2006

(30) Foreign Application Priority Data

Sep. 15, 2004 (JP) ..... 2004-269026

(51) Int. Cl.
*G03G 9/087* (2006.01)

(52) U.S. Cl. ..... 430/109.4; 430/110.1

(58) Field of Classification Search ..... 430/109.4, 430/110.1

See application file for complete search history.

(56) References Cited

U.S. PATENT DOCUMENTS

| | | | | |
|---|---|---|---|---|
| 5,536,612 | A * | 7/1996 | Yamaguchi et al. | 430/137.12 |
| 6,787,280 | B2 | 9/2004 | Yamashita et al. | |
| 6,846,604 | B2 | 1/2005 | Emoto et al. | |
| 6,849,369 | B2 | 2/2005 | Yagi et al. | |
| 6,852,462 | B2 | 2/2005 | Emoto et al. | |
| 6,887,636 | B2 * | 5/2005 | Matsuda et al. | 430/108.1 |
| 6,936,390 | B2 | 8/2005 | Nanya et al. | |
| 7,172,844 | B2 * | 2/2007 | Umemura et al. | 430/108.4 |
| 2001/0018157 | A1 * | 8/2001 | Aoki et al. | 430/109.4 |
| 2002/0051925 | A1 * | 5/2002 | Matsumura et al. | 430/110.3 |
| 2003/0039910 | A1 * | 2/2003 | Shirai et al. | 430/109.4 |
| 2003/0096184 | A1 * | 5/2003 | Kawaji et al. | 430/109.3 |
| 2003/0104297 | A1 * | 6/2003 | Matsuda et al. | 430/108.3 |
| 2003/0118929 | A1 * | 6/2003 | Shirai et al. | 430/108.7 |
| 2003/0129518 | A1 * | 7/2003 | Sawada et al. | 430/109.4 |
| 2003/0138717 | A1 * | 7/2003 | Yagi et al. | 430/110.4 |
| 2003/0180645 | A1 * | 9/2003 | Tavernier et al. | 430/109.4 |
| 2004/0023141 | A1 * | 2/2004 | Shirai et al. | 430/109.3 |
| 2004/0053154 | A1 * | 3/2004 | Tomita et al. | 430/109.4 |

(Continued)

FOREIGN PATENT DOCUMENTS

EP 1455238 * 9/2004

(Continued)

OTHER PUBLICATIONS

Abstract of JP-2004212819. Jul. 29, 2004.*

(Continued)

*Primary Examiner* — Hoa V Le

(74) *Attorney, Agent, or Firm* — Oblon, Spivak, McClelland, Maier & Neustadt, L.L.P.

(57) ABSTRACT

A toner satisfying at least one of the following relationships:

$10° C.<(T1-T2)<60° C.$ and $0<Q2/Q1<2/3$ wherein T1 represents a glass transition temperature of the toner and Q1 represents an endothermic quantity at a melting point thereof before melting when heated from −20° C. to 150° C. at a heating speed of 10° C./min, and T2 represents a glass transition temperature thereof and Q2 represents a an endothermic quantity at a melting point thereof after melting after heated from −20° C. to 150° C. at a heating speed of 10° C./min, cooled to −20° C. at a cooling speed of 10° C./min and heated again at a heating speed of 10° C./min.

13 Claims, 4 Drawing Sheets

U.S. PATENT DOCUMENTS

| | | | | |
|---|---|---|---|---|
| 2004/0131961 | A1 | 7/2004 | Watanabe et al. | |
| 2004/0142264 | A1* | 7/2004 | Tanaka et al. | 430/108.4 |
| 2004/0142266 | A1* | 7/2004 | Sacripante et al. | 430/109.3 |
| 2004/0157146 | A1 | 8/2004 | Tomita et al. | |
| 2004/0265721 | A1* | 12/2004 | Matsuoka et al. | 430/109.4 |
| 2005/0003291 | A1 | 1/2005 | Takada et al. | |
| 2005/0026066 | A1 | 2/2005 | Tanaka et al. | |
| 2005/0031980 | A1 | 2/2005 | Inoue et al. | |
| 2005/0042534 | A1* | 2/2005 | Tanaka et al. | 430/108.4 |
| 2005/0048389 | A1* | 3/2005 | Cheng et al. | 430/108.3 |
| 2005/0074685 | A1* | 4/2005 | Kido et al. | 430/110.2 |
| 2005/0164112 | A1 | 7/2005 | Ohki et al. | |

FOREIGN PATENT DOCUMENTS

| | | | |
|---|---|---|---|
| JP | 62-063940 | | 3/1987 |
| JP | 11-249339 | | 9/1999 |
| JP | 2002-284866 | | 10/2002 |
| JP | 2003-050478 | | 2/2003 |
| JP | 2003-066646 | | 3/2003 |
| JP | 2003-167384 | | 6/2003 |
| JP | 2003-246920 | | 9/2003 |
| JP | 2004-184551 | | 7/2004 |
| JP | 2004-184561 | | 7/2004 |
| JP | 2004212819 | * | 7/2004 |
| JP | 2004-245887 | | 9/2004 |
| JP | 2004-246345 | | 9/2004 |

OTHER PUBLICATIONS

U.S. Appl. No. 11/676,883, filed Feb. 20, 2007, Tanaka.
U.S. Appl. No. 11/687,075, filed Mar. 16, 2007, Yamada, et al.
U.S. Appl. No. 11/685,872, filed Mar. 14, 2007, Uchinokura, et al.
U.S. Appl. No. 11/687,372, filed Mar. 16, 2007, Yamada, et al.
U.S. Appl. No. 11/670,874, filed Feb. 2, 2007, Inoue, et al.
U.S. Appl. No. 11/685,969, filed Mar. 14, 2007, Uchinokura, et al.
U.S. Appl. No. 11/513,175, filed Aug. 31, 2006, Ohki, et al.
U.S. Appl. No. 11/520,642, filed Sep. 14, 2006, Chiaki Tanaka, et al.
U.S. Appl. No. 11/519,893, filed Sep. 13, 2006, Ryota Inoue, et al.
U.S. Appl. No. 11/852,778, filed Sep. 10, 2007, Nagatomo, et al.
U.S. Appl. No. 11/855,806, filed Sep. 14, 2007, Awamura, et al.
U.S. Appl. No. 11/856,379, filed Sep. 17, 2007, Sawada, et al.
U.S. Appl. No. 11/857,791, filed Sep. 19, 2007, Kojima, et al.
U.S. Appl. No. 12/026,937, filed Feb. 6, 2008, Seshita, et al.
U.S. Appl. No. 12/040,451, filed Feb. 29, 2008, Saitoh, et al.
U.S. Appl. No. 12/042,041, filed Mar. 4, 2008, Yamada, et al.
U.S. Appl. No. 12/046,011, filed Mar. 11, 2008, Nagatomo, et al.
U.S. Appl. No. 12/203,278, filed Sep. 3, 2008, Yamada, et al.
U.S. Appl. No. 12/209,583, filed Sep. 12, 2008, Seshita, et al.
U.S. Appl. No. 10/645,804, filed Aug. 22, 2008, Tomita, et al.

* cited by examiner

TONER AND IMAGE FORMING METHOD USING THE TONER

BACKGROUND OF THE INVENTION

1. Field of the Invention

The present invention relates to a toner for use in electrophotographic image forming methods, electrostatic recording methods and electrostatic printing methods.

2. Discussion of the Background

The electrophotographic image forming method typically includes forming an electrostatic latent image on a photoreceptor (an electrostatic latent image bearer); developing the electrostatic latent image with a developer including a toner to form a visible image (a toner image); and transferring and fixing the visible image onto a recording medium such as papers.

The methods of developing the electrostatic latent image are broadly classified to wet developing methods such as a cascade method, a magnetic brush method and a powder cloud method, and dry developing methods using a toner wherein a colorant such as carbon black is dispersed in a natural or synthesized resin. Currently, the dry developing methods are widely used.

As a fixing method used in the dry developing methods, a heat roller fixing method directly contacting a heating roller to the toner image upon application of pressure and fixing the toner image on the transfer material is widely used because the method has good heat efficiency and the heating roller can be downsized. Recently, the heat roller is required to consume less electric power for fixing to save energy.

In order to save energy, the fixer has been improved to further increase the heat energy efficiency, e.g., the heat roller has a thinner layer contacting a toner image and a much shorter warm-up time.

However, the heating roller has a smaller specific heat capacity, and a difference of temperature between a part a recording medium passes and a part the recording medium does not pass thereof becomes large. Accordingly, a melted toner adheres thereto, and after the heating roller makes one revolution, the melted toner adheres to a part of the transfer material, having no image, i.e., a hot offset problem tends to occur. Therefore, a toner is required to have hot offset resistance.

In addition, a heat energy applied to a toner tends to decrease as does in a low-temperature fixer and a high-speed copier for saving energy. A toner fixable at a low temperature typically includes a resin or a wax having a low softening point.

However, such a toner as is fixable at a low temperature is liable to be hardened, i.e., blocked, with other heats such as a heat of an apparatus including the toner or a heat when stored. Further, the toner is difficult to have a wide fixable temperature.

For the purpose of improving the low-temperature fixability of a toner, e.g., Japanese Laid-Open Patent Publication No. 62-63940 discloses a method of including a specific non-olefin crystalline polymer having a sharp melt profile in a binder resin of the toner, Japanese Patent No. discloses a method of including a crystalline polyester having a sharp melt profile therein and Japanese Laid-Open Patent Publication No. 2003-167384 discloses a toner including a crystalline resin and an amorphous resin incompatible with each other.

However, these methods cannot prepare a toner having sufficient low-temperature fixability, and when a glass transition temperature thereof is lowered too much, thermostable preservability thereof deteriorates. In addition, when the molecular weight thereof is decreased to lower the softening point too much, the hot offset occurs at a lower temperature. Therefore, a toner having both low-temperature fixability and thermostable preservability is difficult to prepare.

Because of these reasons, a need exists for a toner having good hot offset resistance, both low-temperature fixability and thermostable preservability, and producing high-quality images.

SUMMARY OF THE INVENTION

Accordingly, an object of the present invention is to provide a toner having good hot offset resistance, both low-temperature fixability and thermostable preservability, and producing high-quality images.

Another object of the present invention is to provide an image forming method using the toner.

These objects and other objects of the present invention, either individually or collectively, have been satisfied by the discovery of a toner satisfying at least one of the following relationships:

$$10° \text{ C.} < (T1 - T2) < 60° \text{ C. and } 0 < Q2/Q1 < 2/3$$

wherein T1 represents a glass transition temperature of the toner before melting when heated from −20° C. to 150° C. at a heating speed of 10° C./min, and T2 represents a glass transition temperature thereof after melting after heated from −20° C. to 150° C. at a heating speed of 10° C./min, cooled to −20° C. at a cooling speed of 10° C./min and heated again at a heating speed of 10° C./min; and Q1 represents an endothermic quantity at a melting point of the toner before melting when heated from −20° C. to 150° C. at a heating speed of 10° C./min, and Q2 represents a an endothermic quantity at a melting point thereof after melting after heated from −20° C. to 150° C. at a heating speed of 10° C./min, cooled to −20° C. at a cooling speed of 10° C./min and heated again at a heating speed of 10° C./min.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
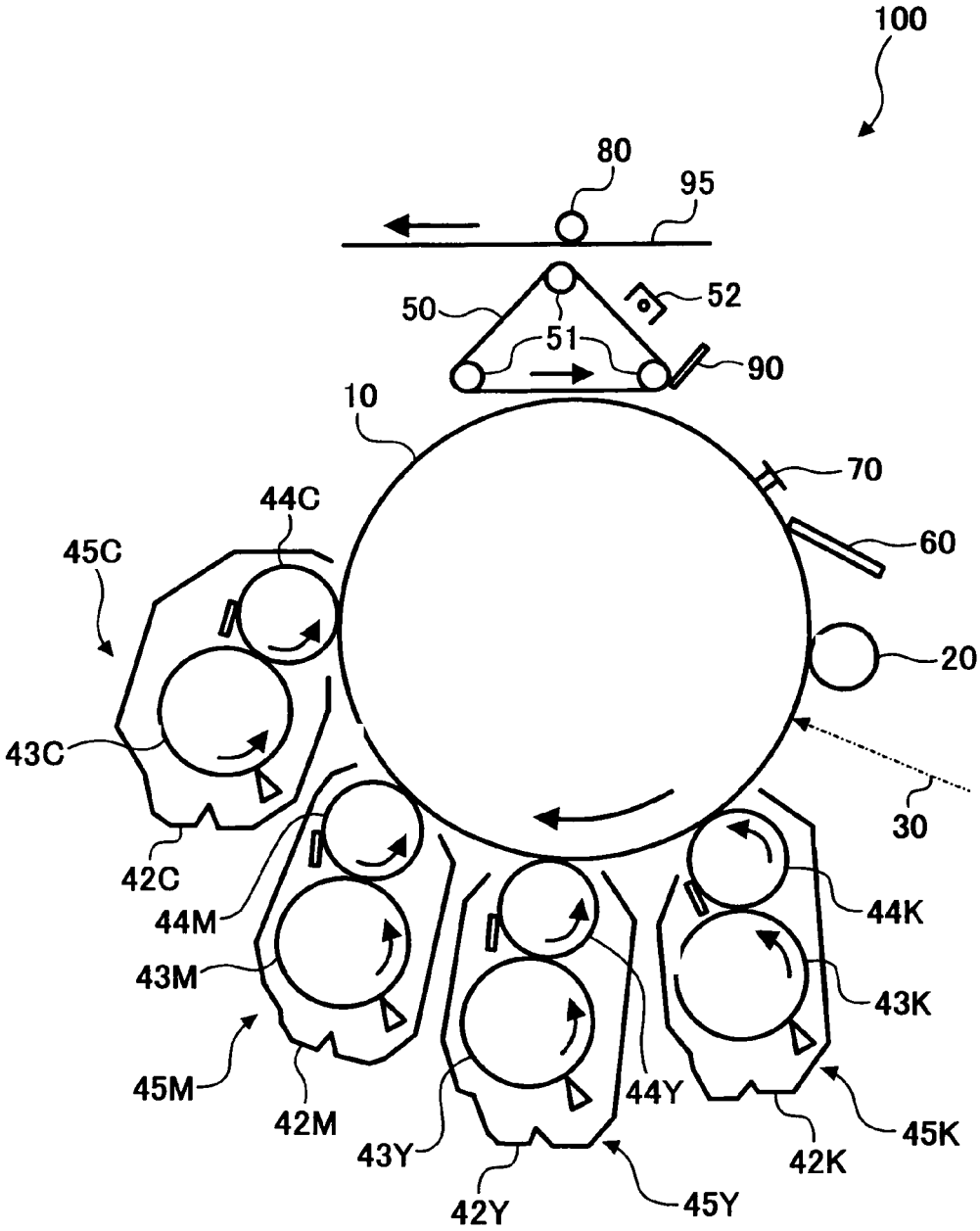
FIG. 1 is a schematic view illustrating an embodiment of image forming apparatus using the image forming method of the present invention.

The present invention provides a toner having good hot offset resistance, both low-temperature fixability and thermostable preservability, and producing high-quality images.

The heat characteristics of a toner include a glass transition temperature, a melting point, a softening point, etc., and depends on a resin forming the toner. A toner including a resin having a lower glass transition temperature is liable to be more fluidized and softened to have better low-temperature fixability. However, when too low, toner properties as a powder, such as powder fluidity and thermostable preservability deteriorate.

As a result of keen studies of the present inventors, they discovered that when plural resins are included in a toner to be compatible with each other, each of the resins has heat characteristics different from those before compatible with each other and the glass transition temperature thereof lowers, which is effective for the toner to have low-temperature fixability. In addition, the compatibility of the resins differs according to a difference of the glass transition temperature of the toner before and after melted upon application of heat. The present inventors discovered that a toner efficiently melts and has both low-temperature fixability and thermostable preservability when the difference is in a specific range.

The toner of the present invention satisfies the following relationship:

$$10° \text{ C.} < (T1 - T2) < 60° \text{ C.}$$

wherein T1 represents a glass transition temperature of the toner before melting when heated from −20° C. to 150° C. at a heating speed of 10° C./min, and T2 represents a glass transition temperature thereof after melting after heated from −20° C. to 150° C. at a heating speed of 10° C./min, cooled to −20° C. at a cooling speed of 10° C./min and heated again at a heating speed of 10° C./min. Plural resins included in the toner are properly compatible with each other, and the toner has both low-temperature fixability and thermostable preservability. The toner produces high-quality images under low temperature fixing conditions.

In addition, the toner of the present invention satisfies the following relationship:

$$0 < Q2/Q1 < 2/3$$

wherein Q1 represents an endothermic quantity at a melting point of the toner before melting when heated from −20° C. to 150° C. at a heating speed of 10° C./min, and Q2 represents a an endothermic quantity at a melting point thereof after melting after heated from −20° C. to 150° C. at a heating speed of 10° C./min, cooled to −20° C. at a cooling speed of 10° C./min and heated again at a heating speed of 10° C./min. Plural resins included in the toner are properly compatible with each other, and the toner has both low-temperature fixability and thermostable preservability. The toner produces high-quality images under low temperature fixing conditions.

Further, the toner of the present invention satisfies the following relationships:

$$10° \text{ C.} < (T1 - T2) < 60° \text{ C. and } 0 < Q2/Q1 < 2/3$$

wherein T1 represents a glass transition temperature of the toner and Q1 represents an endothermic quantity at a melting point thereof before melting when heated from −20° C. to 150° C. at a heating speed of 10° C./min, and T2 represents a glass transition temperature thereof and Q2 represents a an endothermic quantity at a melting point thereof after melting after heated from −20° C. to 150° C. at a heating speed of 10° C./min, cooled to −20° C. at a cooling speed of 10° C./min and heated again at a heating speed of 10° C./min. Plural resins included in the toner are properly compatible with each other, and the toner has both low-temperature fixability and thermostable preservability. The toner produces high-quality images under low temperature fixing conditions.

The image forming method of the present invention includes at least a process of forming an electrostatic latent image on an electrostatic latent image bearer; a process of developing the electrostatic latent image with the toner of the present invention to form a visible image thereon; a transfer process transferring the visible image onto a recording medium; and a fixing process fixing the transferred image on the recording medium. High-quality images having high image density and resolution are produced thereby even under low temperature fixing conditions.

The toner of the present invention includes plural binder resins, wherein the binder resins include at least a crystalline resin and an amorphous resin, and optionally includes other constituents such as a colorant, a release agent, an inorganic particulate material and a charge controlling agent.

The glass transition temperature T1 of a toner before melting is based on a resin having the lowest glass transition temperature among constituents forming the toner. On the other hand, the glass transition temperature T2 after melting has no relation to the constituents forming the toner, and is a new peak formed by compatibility of the resins.

It is essential that the T1 and T2 satisfy the following relationship:

$$10° \text{ C.} < (T1 - T2) < 60° \text{ C.},$$

$$\text{preferably } 12° \text{ C.} < (T1 - T2) < 55° \text{ C., and}$$

$$\text{more preferably } 14° \text{ C.} < (T1 - T2) < 52° \text{ C.}$$

When not less than 60° C., the compatibility of the resins is excessive and the stability of the fixed image deteriorates. When not greater than 10° C., the compatibility thereof is insufficient and the low-temperature fixability of the toner deteriorates.

The glass transition temperature T1 of a toner before melting is preferably 40° C.<T1<80° C., more preferably 45° C.<T1<80° C., and furthermore preferably 45° C.<T1<75° C.

When T1 is less than 40° C., the thermostable preservability of the toner deteriorates. When greater than −80° C., the low-temperature fixability thereof deteriorates.

The melting point Tm of the toner of the present invention before melting is based on constituents forming the toner, and the compatibility of the resins therein after melting changes the endothermic quantity mentioned later.

Tm is preferably from 50 to 150° C., more preferably from 50 to 120° C., and more preferably from 55 to 120° C.

When Tm is less than 50° C., the thermostable preservability of the toner deteriorates. When greater than 150° C., the low-temperature fixability thereof deteriorates.

Tm is preferably higher than T1. When T1 is higher than Tm, the low-temperature fixability of the toner is insufficient.

The glass transition temperatures T1 and T2 and the endothermic quantities at a melting point Q1 and Q2 can be measured by a differential scanning calorimeter, e.g., DSC-60 from Shimadzu Corporation.

The crystalline resin has a melting point and transforms the crystal at the melting point, and has a sharp melt profile wherein a melting viscosity thereof quickly lowers. The crystalline resin has good thermostability just before a melting point thereof, and a viscosity thereof quickly lowers at the melting point. Therefore, the crystalline resin can prepare a toner having both thermostable preservability and low-temperature fixability. In addition, the toner has a good difference between the minimum fixable temperature and hot offset temperature.

It is preferable that the crystalline resin is partially compatible with the amorphous resin, which can lower a temperature at which the melting viscosity of the toner starts lowering. In addition, when the crystalline resin having a melting point higher than that of the amorphous resin is dispersed in the toner, the toner has blocking resistance even when having a high glass transition temperature.

Specific examples of the crystalline resin include, but are not limited to, polymers including polyesters prepared by condensation polymerization between polyol such as ethylene glycol, 1,3-propyleneglycol, 1,4-butanediol, 1,5-penatnediol, 1,6-hexanediol, hexamethylene glycol and tetramethylene glycol and polybasic acids such as a fumaric acid, a maleic acid, an itaconic acid, a terephthalic acid, a succinic acid, an adipic acid and a sebacic acid; polyethers such as polyethylene glycol and polypropylene glycol; and linear alkyl esters such as behenyl acrylate, behenyl methacrylate, behenyl itaconate and stearyl itaconate, as a main polymer, etc. The polyesters (crystalline polyester resins) such as a crystalline polyester resin HP-320 from Nippon Synthetic Chemical Industries Co., Ltd. is preferably used.

Particularly, a crystalline polyester resin formed from an alcohol including diol compounds having 2 to 6 carbon atoms such as 1,4-butandiol and 1,6-hexanediol and their derivatives and an acid such as a maleic acid, a fumaric acid and a succinic acid and their derivatives and having the following formula (1) is preferably used:

$$[—O—CO—(CR_1{=}CR_2)_L—CO—(CH_2)_n—]_m \quad (1)$$

wherein $R_1$ and $R_2$ independently represent a hydrogen atom or a hydrocarbon group, L represents an integer of from 1 to 3, and n and m represent repeat unit numbers.

Methods of controlling crystallinity and softening point of the crystalline polyester resin include a method of designing and using non-linear polyester formed by a condensation polymerization in which polyalcohol having 3 or more valences such as glycerin is added to the alcohol or polycarboxylic acid having 3 or more valences such as trimellitic anhydride is added to the acid when the polyester is formed. The molecular configuration thereof can be identified by a solid NMR, etc.

The orthodichlorobenzene soluble components of the crystalline polyester resin preferably have a weight-average molecular weight (Mw) of from 1,000 to 30,000, and more preferably from 1,000 to 6,500 in a gel permeation chromatography. When less than 1,000, thermostability of the resultant toner deteriorates. When greater than 30,000, the low-temperature fixability thereof deteriorates.

The orthodichlorobenzene soluble components of the crystalline polyester resin preferably have a number-average molecular weight (Mn) of from 500 to 6,000, and more preferably from 500 to 2,000 in a gel permeation chromatography. In addition, a ratio (Mw/Mn) of the weight-average molecular weight (Mw) to the number-average molecular weight (Mn) is preferably from 2 to 8, and more preferably from 2 to 5.

The crystalline polyester resin preferably has a peak in a scope of from 3.5 to 4.0 and a half width of the peak not greater than 1.5 in a gel permeation chromatography, having an x-axis representing log(M) and a y-axis representing % by weight.

In the present invention, the molecular weight is measured by GPC (gel permeation chromatography) as follows. A column is stabilized in a heat chamber having a temperature of 40° C.; THF is put into the column at a speed of 1 ml/min as a solvent; 50 to 200 μl of a THF liquid-solution of a resin, having a sample concentration of from 0.05 to 0.6% by weight, is put into the column; and a molecular weight distribution of the sample is determined by using a calibration curve which is previously prepared using several polystyrene standard samples having a single distribution peak, and which shows the relationship between a count number and the molecular weight. As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 standard polystyrene samples. In addition, an RI (refraction index) detector is used as the detector.

The crystalline polyester resin preferably has a sufficiently low melting point such that the thermostable preservability of the resultant toner does not deteriorate, i.e., of from 50 to 150° C. When less than 50° C., the thermostable preservability of the resultant toner deteriorates and the toner is liable to be blocked in an image developer at an environmental temperature. When greater than 150° C., the minimum fixable temperature of the resultant toner increases and the low-temperature fixability thereof deteriorates.

The crystalline polyester resin preferably has an infrared absorption spectrum such that an absorption due to the δ CH (i.e., out-of-plane angle-changing vibration) of an olefin is observed at $965\pm10$ $cm^{-1}$ or $990\pm10$ $cm^{-1}$, because the low-temperature fixability of the resultant toner improves.

The crystalline polyester resin preferably has an acid value not less than 8 KOH mg/g, and more preferably not less than 20 KOH mg/g in terms of affinity with a paper such that the resultant toner has low-temperature fixability. In addition, the crystalline polyester resin preferably has an acid value not greater than 45 KOH mg/g to improve the hot offset resistance thereof.

The crystalline polyester resin preferably has a hydroxyl value of from 0 to 50 KOH mg/g, and more preferably from 5 to 50 KOH mg/g in terms of improving the low-temperature fixability and charged property of the resultant toner.

The crystalline polyester resin is preferably included in a toner in an amount of from 1 to 30% by weight based on total weight of the resins included therein.

When less than 1% by weight, the compatibility of the total resins decreased and the low-temperature fixability of the resultant toner deteriorates. When greater than 30% by weight, the resins are more plasticized and the storage stability of the resultant toner deteriorates.

The melting viscosity of the amorphous resin gradually decreases as the temperature increases.

Specific examples thereof include, but are not limited to, polyester resins; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl: methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination. Among these resins, the polyester resins formed of polyalcohol and polycarboxylic acid are preferably used.

The polyester resin for use in the preset invention is conventionally prepared by a condensation polymerization between an alcohol and a carboxylic acid. Specific examples of the alcohol include glycols such as ethylene glycol, diethylene glycol, triethylene glycol and propylene glycol; esterified bisphenol such as 1,4-bis (hydroxymethyl)cyclohexane and bisphenol A; bivalent alcohol monomers; and polyalcohol monomers having three or more valences. Specific examples of the carboxylic acid include bivalent organic acid monomers such as maleic acids, fumaric acids, phthalic acids, isophthalic acids, terephthalic acids, succinic and malonic acids; and polycarbonate monomers having three or more valences such as 1,2,4-benzenetricarboxylic acids, 1,2,5-benzenetricarboxylic acids, 1,2,4-cyclohexanetricarboxylic acids, 1,2,4-naphthalenetricarboxylic acids, 1,2,5-hexanetricarboxylic acids, 1,3-dicarboxyl-2-methyl-methylenecarboxypropane and 1,2,7,8-octantetracarboxylic acids.

The above-mentioned amorphous resins can be used alone or in combination, however, a combination of resins which are not compatible with each other before melting and highly compatible therewith when melting is preferably used.

Particulate resins can be used for the purpose of controlling the shape of a toner such as a particle diameter, a particle diameter distribution and an average circularity.

Suitable resins for use as the dispersant include any known thermoplastic or thermosetting resins which can form a dispersion in an aqueous medium. Specific examples of such resins include vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc.

These resins can be used alone or in combination. Among these resins, at least one of the vinyl resins, the polyurethane resins, the epoxy resins and the polyester resins is preferably used because an aqueous dispersion including a microscopic spherical particulate resin can easily be prepared with the resin.

Specific examples of the vinyl resins include homopolymerized or copolymerized polymers such as styrene-(metha) esteracrylate resins, styrene-butadiene copolymers, (metha) acrylic acid-esteracrylate polymers, styrene-acrylonitrile copolymers, styrene-maleic acid anhydride copolymers and styrene-(metha)acrlic acid copolymers.

As the particulate resin, a copolymer including a monomer having at least two unsaturated groups can also be used.

The monomer having at least two unsaturated groups is not particularly limited, and can be selected in accordance with the purpose. Specific examples thereof include a sodium salt of a sulfate ester with an additive of ethylene oxide methacrylate (ELEMINOL RS-30 from Sanyo Chemical Industries, Ltd.), divinylbenzene, 1,6-hexanediolacrylate, etc.

The tetrahydrofuran soluble components of the particulate resin preferably have a weight-average molecular weight (Mw) of from 8,000 to 1,500,000, more preferably from 9,000 to 1,300,000, and furthermore preferably from 10,000 to 1,200,000 in a gel permeation chromatography. When less than 8,000, the thermostable preservability of the resultant toner deteriorates. When greater than 1,500,000, the low-temperature fixability thereof deteriorates.

The particulate resin preferably has a volume-average particle diameter of from 20 to 400 nm, and more preferably from 30 to 350 nm. When less than 20 nm, the particulate resin remaining on the surface of a toner becomes a film and thickly covers all the surface thereof, resulting in deterioration of adherence thereof to a transfer material and increase of a fixable minimum temperature thereof. When greater than 400 nm, the particulate resin prevents a wax from exuding, resulting in insufficient releasability thereof and offset problems.

The volume-average particle diameter thereof can be measured by a laser diffraction/scatter particle diameter distribution measuring instrument, LA-920 from Horiba Ltd.

The particulate resin preferably has a glass transition temperature of from 25 to 150° C., and more preferably from 30 to 120° C. When less than 25° C. or greater than 150° C., the resultant toner has insufficient offset resistance, low-temperature fixability or thermostable preservability.

The particulate resin preferably has a residual volume in a toner in amount of from 0.5 to 8.0% by weight, and more preferably from 0.6 to 7.0% by weight.

When less than 0.5% by weight, the preservability of the toner deteriorates, resulting in occurrence of the blocking problem. When greater than 8.0% by weight, the particulate resin prevents the release agent from exuding from the toner particles, resulting in occurrence of the offset problem.

The amount of a particulate resin remaining on the surface of a toner can be determined by the following method. Namely, the toner is subjected to a pyrolysis gas chromatography to determine the amount of the particulate resin therein by checking the area of a peak specific to a substance which is included in the particulate resin but not included in the other toner constituents. As the detector, a mass spectrometer is preferably used but is not limited thereto.

The particulate resin preferably covers a toner with a coverage of from 75 to 100%, and more preferably from 80 to 100%. When less than 75%, the storage stability of a toner deteriorates and blocking thereof occurs.

The coverage can be measured by an image analyzer analyzing an electron microscopic picture of the surface of a toner.

A toner preferably includes the particulate resin in an amount of from 0.5 to 8.0%, and more preferably from 0.6 to 7.0% by weight. When less than 0.5% by weight, the storage stability thereof deteriorates and blocking thereof occurs. When greater than 8.0% by weight, the particulate resin prevents a wax from exuding, resulting in insufficient releasability thereof and offset problems.

The particulate resin can be prepared by any known polymerization methods, however, preferably prepared in the form of an aqueous dispersion thereof. The aqueous dispersion thereof can be prepared by the following methods:

(1) a method of directly preparing an aqueous dispersion of a vinyl resin from a vinyl monomer by a suspension polymerization method, an emulsification polymerization method, a seed polymerization method or a dispersion polymerization method;

(2) a method of preparing an aqueous dispersion of polyaddition or polycondensation resins such as a polyester resin, a polyurethane resin and an epoxy resin by dispersing a precursor (such as a monomer and an oligomer) or a solution thereof in an aqueous medium under the presence of a dispersant to prepare a dispersion, and heating the dispersion or adding a hardener thereto to harden the dispersion;

(3) a method of preparing an aqueous dispersion of polyaddition or polycondensation resins such as a polyester resin, a polyurethane resin and an epoxy resin by dissolving an emulsifier in a precursor (such as a monomer and an oligomer) or a solution (preferably a liquid or may be liquefied by heat) thereof to prepare a solution, and adding water thereto to subject the solution to a phase-inversion emulsification;

(4) a method of pulverizing a resin prepared by any polymerization methods such as addition condensation, ring scission polymerization, polyaddition and condensation polymerization with a mechanical or a jet pulverizer to prepare a pulverized resin and classifying the pulverized resin to prepare a particulate resin, and dispersing the particulate resin in an aqueous medium under the presence of a dispersant;

(5) a method of spraying a resin solution wherein a resin prepared by any polymerization methods such as addition condensation, ring scission polymerization, polyaddition and condensation polymerization is dissolved in a solvent to prepare a particulate resin, and dispersing the particulate resin in an aqueous medium under the presence of a dispersant;

(6) a method of adding a lean solvent in a resin solution wherein a resin prepared by any polymerization methods such as addition condensation, ring scission polymerization, polyaddition and condensation polymerization is dissolved in a solvent, or cooling a resin solution wherein the resin is dissolved upon application of heat in a solvent to separate out a particulate resin and removing the solvent therefrom, and dispersing the particulate resin in an aqueous medium under the presence of a dispersant;

(7) a method of dispersing a resin solution, wherein a resin prepared by any polymerization methods such as addition condensation, ring scission polymerization, polyaddition and condensation polymerization is dissolved in a solvent, in an aqueous medium under the presence of a dispersant, and removing the solvent upon application of heat or depressure; and (8) a method of dissolving an emulsifier in a resin solution wherein a resin prepared by any polymerization methods such as addition condensation, ring scission polymerization, polyaddition and condensation polymerization is dissolved in a solvent, and adding water thereto to subject the solution to a phase-inversion emulsification.

The toner of the present invention may include other constituents, which are not particularly limited, such as a colorant, a release agent, an inorganic particulate material, a charge controlling agent, a fluidity improver, a cleanability improver and a magnetic material.

The colorant is not particularly limited, and can be selected from known dyes and pigments in accordance with the purpose. Specific examples of the dyes and pigments include carbon black, Nigrosine dyes, black iron oxide, NAPHTHOL YELLOW S(C.I. 10316), HANSA YELLOW 10G (C.I. 11710), HANSA YELLOW 5G (C.I. 11660), HANSA YELLOW G (C.I. 11680), Cadmium Yellow, yellow iron oxide, loess, chrome yellow, Titan Yellow, polyazo yellow, Oil Yellow, HANSA YELLOW GR (C.I. 11730), HANSA YELLOW A (C.I. 11735), HANSA YELLOW RN(C.I. 11740), HANSA YELLOW R (C.I. 12710), PIGMENT YELLOW L (C.I. 12720), BENZIDINE YELLOW G (C.I. 21095), BENZIDINE YELLOW GR (C.I. 21100), PERMANENT YELLOW NCG (C.I. 20040), VULCAN FAST YELLOW 5G (C.I. 21220), VULCAN FAST YELLOW R(C.I. 21135), Tartrazine Lake, QUINOLINE YELLOW LAKE, ANTHRAZANE YELLOW BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, BRILLIANT CARMINE BS, PERMANENT RED F2R(C.I. 12310), PERMANENT RED F4R (C.I. 12335), PERMANENT RED FRL (C.I. 12440), PERMANENT RED FRLL (C.I. 12460), PERMANENT RED F4RH(C.I. 12420), Fast Scarlet VD, VULCAN FAST RUBINE B (C.I. 12320), BRILLIANT SCARLET G, LITHOL RUBINE GX (C.I. 12825), PERMANENT RED F5R, BRILLIANT CARMINE 6B, Pigment Scarlet 3B, Bordeaux 5B, Toluidine Maroon, PERMANENT BORDEAUX F2K (C.I. 12170), HELIO BORDEAUX BL (C.I. 14830), BORDEAUX 10B, BON MAROON LIGHT (C.I. 15825), BON MAROON MEDIUM (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazored, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS(C.I. 69800), INDANTHRENE BLUE BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A toner preferably includes the colorant in an amount of from 1 to 15% by weight, and more preferably from 3 to 10% by weight of the toner. When less than 1% by weight, the resultant toner cannot produce images with high image density. When greater than 15 5 by weight, problems in that the resultant toner cannot produce images with high image density and has poor electrostatic properties due to defective dispersion of the colorant in the toner occur.

Masterbatches, which are complexes of a colorant with a resin, can be used as the colorant of the toner of the present invention. Specific examples of the resins for use as the binder resin of the master batches include polymers of styrene or styrene derivatives, styrene copolymers, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

Specific examples of the polymers of styrene or styrene derivatives include polystyrene, poly-p-chlorostyrene and polyvinyltoluene. Specific examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl $\alpha$-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The masterbatches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

The release agent is not particularly limited, and can be selected from known release agents in accordance with the purpose.

Suitable materials for use as the release agent include waxes. Specific examples of the waxes include synthetic waxes such as low-molecular-weight polyolefin waxes, synthetic hydrocarbon waxes, natural waxes, petroleum waxes, higher fatty acids and their derivatives, higher fatty acid amide, and modified versions of these waxes. These waxes can be used alone or in combination.

Specific examples of the low-molecular-weight polyolefin waxes include low molecular weight polyethylene and polypropylene, etc.

Specific examples of the synthetic hydrocarbon waxes include Fischer-Tropsch waxes, etc.

Specific examples of the natural waxes include bees waxes, carnauba waxes, candelilla waxes, rice waxes, montan waxes, etc.

Specific examples of the petroleum waxes include paraffin waxes, microcrystalline waxes, etc.

Specific examples of the higher fatty acids include stearic acid, palmitic acid, myristic acid, etc.

The melting point of the release agent is not particularly limited, and can be selected in accordance with the purpose. However, the melting point is preferably from 65 to 110° C., and more preferably from 70 to 90° C.

When the melting point is lower than 65° C., the release agent has an adverse effect on the blocking resistance of the resultant toner. When higher than 110° C., the resultant toner causes a cold offset problem and a paper is wound around the fixing roller.

The content of the release agent in a toner is not particularly limited, and can be selected in accordance with the purpose. However, the content is preferably from 1 to 20 parts by weight, and more preferably from 3 to 10 parts by weight, per 100 parts by weight of the toner. When greater than 20 parts by weight, the resultant toner has poor fluidity and contaminates members in an apparatus.

The inorganic particulate material is not particularly limited, and can be selected from known inorganic particulate materials in accordance with the purpose. Specific examples thereof include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. These are used alone or in combination.

The inorganic particulate material preferably has a primary particle diameter of from 5 nm to 2 μm, and more preferably from 5 nm to 500 nm. Further, the inorganic particulate material preferably has a specific surface area of from 20 to 500 $m^2/g$ when measured by a BET method.

A toner preferably includes the inorganic particulate material of from 0.01% to 5.0% by weight, and more preferably from 0.01% to 2.0% by weight.

The inorganic particulate material is preferably used as an external additive for a toner.

The charge controlling agent is not particularly limited, and can be selected from known charge controlling agents in accordance with the purpose. However, colorless or white charge controlling agents are preferably used because colored charge controlling agents change the color tone of a toner. Specific examples thereof include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. Among these materials, metal salts of salicylic acid and salicylic acid derivatives are preferably used. These materials can be used alone or in combination. Specific examples of the metal for use in the metal salts mentioned above include aluminum, zinc, titanium, strontium, boron, silicon, nickel, iron, chromium, zirconium, etc.

Specific examples of the marketed charge controlling agents include BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenylmethane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, a quaternary ammonium group, etc.

The charge controlling agent can be included in the toner by a method in which a mixture of the charge controlling agent and the masterbatch, which have been melted and kneaded, is dissolved or dispersed in a solvent and the resultant solution or dispersion is dispersed in an aqueous medium to prepare a toner dispersion or a method in which the charge controlling agent is dissolved or dispersed together with other toner constituents to prepare a toner constituent mixture liquid and the mixture liquid is dispersed in an aqueous medium to prepare a toner dispersion. Alternatively, the charge controlling agent can be fixed on a surface of the toner after toner particles are prepared.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 1 to 5 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner increases, resulting in deterioration of fluidity and decrease of image density.

The fluidity improver is a surface treatment agent to increase the hydrophobicity of a toner to prevent deterioration of fluidity and charge ability thereof even in an environment of high humidity. Specific examples thereof include a silane coupling agent, a sililating agent a silane coupling agent having an alkyl fluoride group, an organic titanate coupling agent, an aluminium coupling agent a silicone oil and a modified silicone oil.

The cleanability improver is added to remove a developer remaining on a photoreceptor and a first transfer medium after transferred. Specific examples of the cleanability improver include fatty acid metallic salts such as zinc stearate, calcium stearate and stearic acid; and polymer particles prepared by a soap-free emulsifying polymerization method such as polymethylmethacrylate particles and polystyrene particles. The polymer particles comparatively have a narrow particle diameter distribution and preferably have a volume-average particle diameter of from 0.01 to 1 μm.

Methods of preparing the toner of the present invention are not particularly limited, and include a kneading and pulverizing method melting and kneading the toner constituents and pulverizing and classifying the kneaded toner constituents; a suspension polymerization method; an emulsification polymerization condensation method; a dissolution suspension method; a method of reacting a compound having a group including an active hydrogen with a polymer capable of reacting therewith in an aqueous medium. In terms of improving a disadvantage of the kneading and pulverizing method wherein resins in a toner are compatible with each other when kneaded with a large shearing force and the resultant toner has insufficient low-temperature fixability, the toner granulated in an aqueous medium is preferably used. In terms of improving a disadvantage of the suspension polymerization method wherein the toner constituents are polymerized and compatible with each other at the same time after suspended, which is difficult to control, and a disadvantage of the emulsification polymerization condensation method wherein the toner constituents are compatible with each other when fusion bonded after agglomerated, a toner prepared by the dissolution suspension method is preferably used, and a toner prepared by the method of reacting a compound having a group including an active hydrogen with a polymer capable of reacting therewith in an aqueous medium is more preferably used.

Namely, the toner is preferably prepared by dissolving or dispersing toner constituents including at least the compound having a group including an active hydrogen and the polymer capable of reacting therewith in an organic solvent to prepare a solution or a dispersion; emulsifying or dispersing the solution or dispersion in an aqueous medium to react the compound having a group including an active hydrogen with the polymer capable of reacting therewith to prepare a reaction product; and removing the organic solvent therefrom. The toner constituents include at least the compound having a group including an active hydrogen, the polymer capable of reacting there with and the crystalline resin, and optionally an unmodified polyester resin and the other constituents.

The toner constituents solution or a dispersion is prepared by dissolving or dispersing the toner constituents including at least the compound having a group including an active hydrogen and the polymer capable of reacting therewith in an organic solvent.

The compound having a group including an active hydrogen works as an elongation agent or a crosslinker when the polymer capable of reacting therewith is subjected to an elongation or a crosslinking reaction.

The compound having a group including an active hydrogen is not particularly limited, and can be selected in accordance with the purpose, provided that the compound has having a group an active hydrogen. For example, when he polymer capable of reacting therewith is a polyester prepolymer including an isocyanate group (A), amines (B) capable of polymerizing the polyester prepolymer including an isocyanate group (A) through an elongation or a crosslinking reaction are preferably used.

The group including an active hydrogen is not particularly limited, and can be selected in accordance with the purpose. Specific examples thereof include a hydroxyl group (an alcoholic hydroxyl group and a phenolic hydroxyl group), an amino group, a carboxyl group, a mercapto group, etc. These can be used alone or in combination. In particular, the alcoholic hydroxyl group is preferably used.

The amines (B) are not particularly limited, and can be selected in accordance with the purpose. Specific examples thereof include diamines (B1), polyamines (B2) having three or more amino groups, amino alcohols (B3), amino mercaptans (B4), amino acids (B5) and blocked amines (B6) in which the amines (B1 to B5) mentioned above are blocked.

These can be used alone or in combination. Among these amines (B), the diamines (B1) and a mixture of the diamine (B1) and a small amount of the polyamine (B2) is preferably used in particular.

Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane and diaminocyclohexane and isophorondiamine); aliphatic diamines such as ethylene diamine, tetramethylene diamine and hexamethylene diamine; etc.

Specific examples of the polyamines (B2) having three or more amino groups include diethylene triamine, triethylene tetramine.

Specific examples of the amino alcohols (B3) include ethanol amine and hydroxyethyl aniline.

Specific examples of the amino mercaptan (B4) include aminoethyl mercaptan and aminopropyl mercaptan.

Specific examples of the amino acids (B5) include amino propionic acid and amino caproic acid.

Specific examples of the blocked amines (B6) include ketimine compounds which are prepared by reacting one of the amines (B1) to (B5) mentioned above with a ketone such as acetone, methyl ethyl ketone and methyl isobutyl ketone; oxazoline compounds, etc.

A reaction terminator can be used to terminate the elongation or crosslinking reaction between the compound having a group including an active hydrogen and the polymer capable of reacting therewith. The reaction terminator is preferably used because the molecular weight of the polyester resin can be controlled so as to be in a desired range. Specific examples thereof include monoamines such as diethyle amine, dibutyl amine, butyl amine and lauryl amine, and blocked amines, i.e., ketimine compounds prepared by blocking the monoamines.

A mixing ratio, i.e., a ratio [NCO]/[NHx] of the isocyanate group [NCO] in the prepolymer (A) to the amino group [NHx] in the amine (B) is preferably from 1/3 to 3/1, more preferably from 1/2 to 2/1 and even more preferably from 1/1.5 to 1.5/1.

When the mixing ratio ([NCO]/[NHx]) is less than 1/3, the low-temperature fixability of the resultant toner deteriorates. When greater than 3/1, the hot offset resistance thereof deteriorates.

The polymer capable of reacting with the compound having a group including an active hydrogen (hereinafter referred to as a "prepolymer") is not particularly limited, and can be selected in accordance with the purpose, provided that the polymer at least has a site capable of reacting with the compound having a group including an active hydrogen. Specific examples thereof include a polyol resins, a polyacrylic resin, a polyester resin, an epoxy resin, their derivatives, etc.

These can be used alone or in combination. Among these resins, the polyester resin having high fluidity when melting and transparency is preferably used.

The site capable of reacting with the compound having a group including an active hydrogen is not particularly limited, and can be selected in accordance with the purpose. Specific examples thereof include an isocyanate group, an epoxy group, a carboxylic acid group, an acid chloride group, etc.

These can be used alone or in combination. Among these groups, the isocyanate group is preferably used.

Among the prepolymers, a polyester resin including a group formed by urea bonding (RMPE) is preferably used because of being capable of controlling the molecular weight of the polymer components, imparting oilless low-temperature fixability to a dry toner, and good releasability and fixability thereto even in an apparatus without a release oil applicator to a heating medium for fixing.

The group formed by urea bonding includes an isocyanate group, etc. When the group formed by urea bonding of the polyester resin including a group formed by urea bonding (RMPE) is an isocyanate group, the polyester prepolymer including an isocyanate group (A) is preferably used as the polyester resin including a group formed by urea bonding (RMPE).

The polyester prepolymer including an isocyanate group (A) is not particularly limited, and can be selected in accordance with the purpose. For example, the polyester prepolymers including an isocyanate group (A) can be prepared by reacting a polycondensation product of a polyol (PO) and a polycarboxylic acid (PC), i.e., a polyester resin having a group including an active hydrogen atom, with a polyisocyanate (PIC).

The polyol (PO) is not particularly limited, and can be selected in accordance with the purpose. For example, suitable polyols (PO) include diols (DIO), polyols (TO) having three or more hydroxyl groups, and mixtures of DIO and TO. These can be used alone or in combination. Preferably, diols (DIO) alone or mixtures of a diol (DIO) with a small amount of polyol (TO) are used.

Specific examples of the diols DIO include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and adducts of bisphenols with an alkylene oxide are preferable. More preferably, adducts of bisphenols with an alkylene oxide, and mixtures of an adduct of bisphenols with an alkylene oxide and an alkylene glycol having from 2 to 12 carbon atoms are used.

Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide such as ethylene oxide, propylene oxide and butylene oxide.

A mixing ratio (DIO/TO) of the DIO to the TO is preferably 100/0.01 to 10, and more preferably 100/0.01 to 1.

The polycarboxylic acid (PC) is not particularly limited, and can be selected in accordance with the purpose. For example, suitable polycarboxylic acids (PC) include dicarboxylic acids (DIC) and polycarboxylic acids (TC) having three or more carboxyl groups. These can be used alone or in combination. Preferably, dicarboxylic acids (DIC) alone and mixtures of a dicarboxylic acid (DIC) with a small amount of polycarboxylic acid (TC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids. (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

When the polycarboxylic acid (PC) is reacted with a polyol (1), anhydrides or lower alkyl esters (e.g., methyl esters, ethyl esters or isopropyl esters) of the polycarboxylic acids mentioned above can also be used as the polycarboxylic acid (PC).

A mixing ratio (DIC/TC) of the DIC to the TC is preferably 100/0.01 to 10, and more preferably 100/0.01 to 1.

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

The polyester prepolymer including an isocyanate group (A) preferably includes the polyol (PO) in an amount of from 0.5 to 40% by weight, more preferably from 1 to 30% by weight, and even more preferably from 2 to 20% by weight.

When less than 0.5% by weight, the hot offset resistance of the resultant toner deteriorates, which is difficult to have both thermostable preservability and low-temperature fixability. When greater than 40% by weight, the low-temperature fixability thereof deteriorates.

Specific examples of the polyisocyanates (PIC) include aliphatic polyisocyanates (e.g., tetramethylene diisocyanate, hexamethylenediisocyanate and 2,6-diisocyanatemethylcaproate, octamethylene diisocyanate, decamethylene diisocyanate, dodecamethylene diisocyanate, tetradecamethylene diisocyanate, trimethylhexane diisocyanate, etc.); alicyclic polyisocyanates (e.g., isophoronediisocyanate, cyclohexylmethane diisocyanate, etc.); aromatic diisocianates (e.g., tolylene diisocyanate, diphenylmethane diisocyanate, 1,5-naphthylene diisocyanate, diphenylene-4,4'-diisocyanate, 4,4'-diisocyanate-3,3-dimethyl diphenyl, 3-methyldiphenylmethane-4,4'-diisocynate, diphenylether-4,4'-diisocyanate, etc.); aromatic aliphatic diisocyanates (e.g., $\alpha$, $\alpha$, $\alpha'$, $\alpha'$-tetramethyl xylylene diisocyanate, etc.); isocyanurates (e.g., tris-isocyanatealkyl-isocyanurate, triisocyanatecycloalkyl-isocyanurate, etc.); blocked polyisocyanates in which the polyisocyanates mentioned above are blocked with phenol derivatives, oximes or caprolactams; etc.

These compounds can be used alone or in combination.

Suitable mixing ratio (i.e., the equivalence ratio [NCO]/[OH]) of the [NCO] group of the polyisocyanate (PIC) to the [OH] group of the polyester resin having a group including an active hydrogen (such as a polyester resin including a hydroxyl group) is from 5/1 to 1/1, preferably from 4/1 to 1.2/1 and more preferably from 2.5/1 to 1.5/1.

When greater than 5/1, the low-temperature fixability of the resultant toner deteriorates. When less than 1/1, the offset resistance thereof deteriorates.

The polyester prepolymer including an isocyanate group (A) preferably includes the polyisocyanate (PIC) in an amount of from 0.5 to 40% by weight, more preferably from 1 to 30% by weight, and even more preferably from 2 to 20% by weight.

When less than 0.5% by weight, the hot offset resistance of the resultant toner deteriorates, which is difficult to have both thermostable preservability and low-temperature fixability. When greater than 40% by weight, the low-temperature fixability thereof deteriorates.

An average number of the isocyanate group included in the polyester prepolymer including an isocyanate group (A) per molecule is preferably not less than 1, more preferably from 1.2 to 5, and even more preferably from 1.5 to 4.

When less than 1, the polyester resin including a group formed by urea bonding (RMPE) has a lower molecular weight, and the hot offset resistance of the resultant toner deteriorates.

The tetrahydrofuran (THF) soluble components of the polymer capable of reacting with the compound having a group including an active hydrogen preferably have a weight-average molecular weight (Mw) of from 1,000 to 30,000, and more preferably from 1,500 to 15,000 in a gel permeation chromatography. When less than 1,000, the thermostable preservability of the resultant toner deteriorates. When greater than 30,000, the low-temperature fixability thereof deteriorates.

The toner constituents may include known binder resins. The binder resins are not particularly limited, and can be selected in accordance with the purpose. For example, a polyester resin, particularly an unmodified polyester resin is preferably used.

The unmodified polyester resin included in a toner improves the low-temperature fixability thereof and glossiness of images produced thereby.

The unmodified polyester resin includes the examples of the polyester resin including a group formed by urea bonding (RMPE), i.e., the polycondensated products between the PO and PC.It is preferable that the unmodified polyester resin is partially compatible with the polyester resin including a group formed by urea bonding, i.e., these have a compatible similar structure because the resultant toner has good low-temperature fixability and hot offset resistance.

The tetrahydrofuran (THF) soluble components of the unmodified polyester resin preferably have a weight-average molecular weight (Mw) of from 1,000 to 30,000, and more preferably from 1,500 to 15,000 in a gel permeation chromatography. When less than 1,000, the thermostable preservability of the resultant toner deteriorates, and therefore the content of the unmodified polyester resin having weight-average molecular weight (Mw) less than 1,000 needs to be 8 to 28% by weigh. When greater than 30,000, the low-temperature fixability thereof deteriorates.

The unmodified polyester resin preferably has a glass transition temperature of from 30 to 70° C., more preferably from 35 to 60° C., and even more preferably from 35 to 50° C. When less than 30° C., the thermostable preservability of the resultant toner deteriorates. When greater than 70° C., the low-temperature fixability thereof is insufficient.

The unmodified polyester resin preferably has a hydroxyl value not less than 5 KOH mg/g, more preferably from 10 to 120 KOH mg/g, and even more preferably from 20 to 80 KOH mg/g. When less than 5 KOH mg/g, the resultant toner is difficult to have both thermostable preservability and low-temperature fixability.

The unmodified polyester resin preferably has an acid value of from 1.0 to 50.0 KOH mg/g, and more preferably from 1.0 to 30.0 KOH mg/g. The resultant toner having such an acid value is typically liable to be negatively charged.

A mixing ratio (RMPE/PE) by weight of the polyester resin including a group formed by urea bonding (RMPE) to the unmodified polyester resin (PE) is preferably from 5/95 to 25/75, and more preferably from 10/90 to 25/75.

When the mixing ratio by weight of the PE is greater than 95, the hot offset resistance of the resultant toner deteriorates. When less than 75, the low-temperature fixability thereof and glossiness of images produced thereby deteriorates.

The organic solvent is not particularly limited, and can be selected in accordance with the purpose, provided the toner constituents can be dissolved or dispersed therein. The solvent is preferably volatile and has a boiling point lower than 150° C. because of easily removed. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. Particularly, the ethyl acetate is more preferably used.

The usage thereof is preferably from 40 to 300 parts by weight, more preferably from 60 to 140, and even more preferably from 80 to 120 parts by weight, per 100 parts by weight of the toner constituents.

The solution or dispersion prepared by dissolving or dispersing the toner constituents in the organic solvent is emulsified or dispersed in the aqueous medium, wherein a reaction between the compound having a group including an active hydrogen and the polymer capable of reacting therewith is performed.

The aqueous medium is not particularly limited, and can be selected in accordance with the purpose. For example, water, a water-soluble solvent, a mixture thereof, etc. can be used. Particularly, water us preferably used.

Specific examples of the water-soluble solvents include as alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc. These can be used alone or in combination.

The dispersing method is not particularly limited, and known mixers and dispersing machines such as low shearing force type dispersing machines, high shearing force type dispersing machines, friction type dispersing machines, high pressure jet type dispersing machines and ultrasonic dispersing machine can be used. In order to prepare the toner for use in the present invention, it is preferable to prepare an emulsion including particles having an average particle diameter of from 2 to 20 μm. Therefore, high shearing force type dispersing machines are preferably used.

When high shearing force type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes. The temperature in the dispersing process is generally 0 to 150° C. (under pressure), and preferably from 40 to 98° C. The processing temperature is preferably as high as possible because the viscosity of the dispersion decreases and thereby the dispersing operation can be easily performed.

The usage of the aqueous medium is preferably from 50 to 2,000 parts by weight, and more preferably from 100 to 1,000 parts by weight per 100 parts by weight of the toner constituents.

When less than 50 parts by weight, the toner constituents are not well dispersed therein, and therefore the resultant toner does not have a desired particle diameter. When greater than 2,000 parts by weight, the production cost increases.

A binder resin including a product produced by a reaction between the compound having a group including an active hydrogen and the polymer capable of reacting therewith in the aqueous medium, and known resins such as the unmodified polyester resin preferably has a weight-average molecular weight not less than 3,000, more preferably of from 5,000 to 1,000,000, and even more preferably of from 7,000 50 500,000.

When less than 3,000, the hot offset resistance of the resultant toner deteriorates.

The binder resin preferably has a glass transition temperature of from 30 to 70° C., and more preferably from 40 to 65° C. A toner including the polyester resin formed from the crosslinking or elongation reaction has good preservability even when having a glass transition temperature lower than that of the conventional polyester toners.

When less than 30° C., the thermostable preservability of the resultant toner deteriorates. When greater than 70° C., the low-temperature fixability thereof deteriorates.

The binder resin is not particularly limited, and can be selected in accordance with the purpose. For example, polyester resins are preferably used.

The polyester resins are not particularly limited, and can be selected in accordance with the purpose. For example, urea-modified polyester resins are preferably used.

The urea-modified polyester can be prepared by reacting the amines (B) with the polyester prepolymer including an isocyanate group (A) in the aqueous medium.

The urea-modified polyester can include a urethane bonding besides a urea bonding, and a molecular ratio (urea bonding/urethane bonding) of the urea bonding to the urethane bonding is preferably from 100/0 to 10/90, more preferably from 80/20 to 20/80, and even more preferably from 60/40 to 30/70.

When the urea bonding is less than 10, the hot offset resistance of the resultant toner deteriorates.

The urea-modified polyester includes (1) a mixture of urea-modified polyester prepolymer with isophoronediamine, which is formed from a reaction between a polycondensate of an adduct of bisphenol A with 2 moles of ethylene oxide and an isophthalic acid, and isophoronediisocyanate; and a polycondensate of an adduct of bisphenol A with 2 moles of ethylene oxide and an isophthalic acid, (2) a mixture of urea-modified polyester prepolymer with isophoronediamine, which is formed from a reaction between a polycondensate of an adduct of bisphenol A with 2 moles of ethylene oxide and an isophthalic acid, and isophoronediisocyanate; and a polycondensate of an adduct of bisphenol A with 2 moles of ethylene oxide and a terephthalic acid, (3) a mixture of urea-modified polyester prepolymer with isophoronediamine, which is formed from a reaction between a polycondensate of an adduct of bisphenol A with 2 moles of ethylene oxide/an adduct of bisphenol A with 2 moles of propylene oxide and a terephthalic acid, and isophoronediisocyanate; and a polycondensate of an adduct of bisphenol A with 2 moles of ethylene oxide/an adduct of bisphenol A with 2 moles of propylene oxide, (4)) a mixture of urea-modified polyester prepolymer with isophoronediamine, which is formed from a reaction between a polycondensate of an adduct of bisphenol A with 2 moles of ethylene oxide/an adduct of bisphenol A with 2 moles of propylene oxide and a terephthalic acid, and isophoronediisocyanate; and a polycondensate of an adduct of bisphenol A with 2 moles of propylene oxide, (5) a mixture of urea-modified polyester prepolymer with hexamethylenediamine, which is formed from a reaction between a polycondensate of an adduct of bisphenol A with 2 moles of ethylene oxide and a terephthalic acid, and isophoronediisocyanate; and a polycondensate of an adduct of bisphenol A with 2 moles of ethylene oxide, (6) a mixture of urea-modified polyester prepolymer with hexamethylenediamine, which is formed from a reaction between a polycondensate of an adduct of bisphenol A with 2 moles of ethylene oxide and a terephthalic acid, and isophoronediisocyanate; and a polycondensate of an adduct of bisphenol A with 2 moles of ethylene oxide/an adduct of bisphenol A with 2 moles of propylene oxide (7) a mixture of urea-modified polyester prepolymer with ethylenediamine, which is formed from a reaction between a polycondensate of an adduct of bisphenol A with 2 moles of ethylene oxide and a terephthalic acid, and isophoronediisocyanate; and a polycondensate of an adduct of bisphenol A with 2 moles of ethylene oxide, (8) a mixture of urea-modified polyester prepolymer with hexamethylenediamine, which is formed from a reaction between a polycondensate of an adduct of bisphenol A with 2 moles of ethylene oxide and an isophthalic acid, and diphenylmethanediisocyanate; and a polycondensate of an adduct of bisphenol A with 2 moles of ethylene oxide and an isophthalic acid, (9) a mixture of urea-modified polyester prepolymer with hexamethylenediamine, which is formed from a reaction between a polycondensate of an adduct of bisphenol A with 2 moles of ethylene oxide/an adduct of bisphenol A with 2 moles of propylene oxide and an terephthalic acid/dodecenyl succinate anhydride, and diphenylmethanediisocyanate; and a polycondensate of an adduct of bisphenol A with 2 moles of ethylene oxide/an adduct of bisphenol A with 2 moles of propylene oxide and an terephthalic acid, and (10) a mixture of urea-modified polyester prepolymer with hexamethylenediamine, which is formed from a reaction between a polycondensate of an adduct of bisphenol A with 2 moles of ethylene oxide and an isophthalic acid, and toluenediisocyanate; and a polycondensate of an adduct of bisphenol A with 2 moles of ethylene oxide and an isophthalic acid.

The organic solvent is removed while the reaction between the compound having a group including an active hydrogen and the polymer capable of reacting therewith is performed in the aqueous medium or after the reaction.

Methods of removing the solvent include (1) a method which the emulsion is gradually heated to perfectly evaporate the organic solvent in the emulsion, (2) a method in which the emulsion is sprayed in a dry environment to dry the organic solvent in the drops of the toner constituent liquid and water in the emulsion, thereby forming toner particles, and (3) a method which the emulsion is gradually depressurized to perfectly evaporate the organic solvent in the emulsion.

Specific examples of the dry environment include gases of air, nitrogen, carbon dioxide, combustion gas, etc., which are preferably heated to a temperature not lower than the boiling point of the solvent having the highest boiling point among the solvents included in the emulsion. Toner particles having desired properties can be rapidly prepared by performing this treatment using a spray dryer, a belt dryer, a rotary kiln, etc.

An embodiment of the method of preparing a toner by reacting the compound having a group including an active hydrogen with the polymer capable of reacting therewith in the aqueous medium will be explained.

The method includes preparation of the aqueous medium, preparation of the solution or dispersion of the toner constituents, emulsification or dispersion of the solution or dispersion of the toner constituents in the aqueous medium, production of a binder resin formed of the reaction between the compound having a group including an active hydrogen and the polymer capable of reacting therewith, removal of the organic solvent, synthesis of the polymer capable of reacting with the compound having a group including an active hydrogen (prepolymer), synthesis of the compound having a group including an active hydrogen, etc.

The particulate resin is dispersed in the aqueous medium. The aqueous medium preferably includes the particulate resin in an amount of from 0.5 to 10% by weight.

The solution or dispersion of the toner constituents can be prepared by dissolving or dispersing toner constituents such as the compound having a group including an active hydrogen, the polymer capable of reacting there with, the crystalline resin, the colorant, the release agent, the charge controlling agent, the unmodified polyester resin in the organic solvent.

The toner constituents besides the polymer capable of reacting with the compound having a group including an active hydrogen (prepolymer) may be added the aqueous medium when the particulate resin is dispersed therein.

When the solution or dispersion of the toner constituents is emulsified or dispersed in the aqueous medium, the compound having a group including an active hydrogen and the polymer capable of reacting therewith are subjected to an elongation or crosslinking reaction to produce a binder resin.

The binder resin such as the urea-modified polyester resin may be produced by (1) emulsifying or dispersing the solution or dispersion of the toner constituents including the polymer capable of reacting with the compound having a group including an active hydrogen such as the prepolymer including an isocyanate group (A) with the compound having a group including an active hydrogen such as the amines (B) in the aqueous medium to be subjected to an elongation or a crosslinking reaction; (2) emulsifying or dispersing the solution or dispersion of the toner constituents in the aqueous medium previously including the compound having a group including an active hydrogen to be subjected to an elongation or a crosslinking reaction; and (3) emulsifying or dispersing the solution or dispersion of the toner constituents in the aqueous medium, and adding the compound having a group including an active hydrogen thereto to be subjected to an elongation or a crosslinking reaction, wherein the modified polyester is preferentially formed on the surface of the toner, which can have a concentration gradient thereof.

The reaction time of the elongation or crosslinking reaction between the compound having a group including an active hydrogen and the polymer capable of reacting therewith is preferably from 10 min to 40 hrs, and more preferably from 2 to 24 hrs. The reaction temperature is preferably from 0 to 150° C., and more preferably from 40 to 98° C.

Methods of stably forming the dispersion including the polymer capable of reacting with the compound having a group including an active hydrogen, such as the polyester prepolymer including an isocyanate group (A) in the aqueous medium include, e.g., a method of adding the solution or dispersion prepared by dissolving or dispersing the polymer capable of reacting with the compound having a group including an active hydrogen such as the polyester prepolymer including an isocyanate group (A), the colorant, the release agent, the charge controlling agent and the unmodified polyester resin in the organic solvent, into the aqueous medium, and dispersing the solution or dispersion therein with a shearing force.

In order to stabilize the dispersion (oil drops of the solution or dispersion of the toner constituents) and sharpen a particle diameter thereof while forming a desired shape thereof, a dispersant is preferably used.

The dispersants are not particularly limited, and can be selected in accordance with the purpose. For example, surfactants, inorganic dispersants hardly soluble in water, polymer protective colloids are preferably used. These can be used alone or in combination.

The surfactants include anionic surfactants, cationic surfactants, nonionic surfactants, ampholytic surfactants, etc. Specific examples of the anionic surfactants include an alkylbenzene sulfonic acid salt, an α-olefin sulfonic acid salt, a phosphoric acid salt, etc., and anionic surfactants having a fluoroalkyl group are preferably used. Specific examples thereof include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfo nate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl($C_6$-$C_{10}$) sulfoneamidepropyltrimethylammonium salts, salts of perfluoroalkyl (C6-C10)-N-ethylsulfonylglycin, monoperfluoroalkyl(C6-C16)ethylphosphates, etc. Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE®DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP®EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants include amine salts such as an alkyl amine salt, an aminoalcohol fatty acid derivative, a polyamine fatty acid derivative and an imidazoline; and quaternary ammonium salts such as an alkyltrimethyl ammonium salt, a dialkyldimethyl ammonium salt, an alkyldimethyl benzyl ammonium salt, a pyridinium salt, an alkyl isoquinolinium salt and a benzethonium chloride. Among the cationic surfactants, primary, secondary and tertiary aliphatic amines having a fluoroalkyl group, aliphatic quaternary ammonium salts such as perfluoroalkyl(C6-C10) sulfoneamidepropyltrimethylammonium salts, benzalkonium salts, benzetonium chloride, pyridinium salts, imidazolinium salts, etc. are preferably used. Specific examples of the marketed products thereof include SARFRONOS-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Specific examples of the nonionic surfactants include a fatty acid amide derivative, a polyhydric alcohol derivative, etc.

Specific examples of the ampholytic surfactants include alanine, dodecyldi(aminoethyl)glycin, di (octylaminoethyle) glycin, and N-alkyl-N,N-dimethylammonium betaine, etc.

Specific examples of the inorganic surfactants hardly soluble in water include tricalciumphosphate, calcium carbonate, colloidal titanium oxide, colloidal silica, and hydroxyapatite.

Specific examples of the protective colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

In addition to the dispersants, a dispersion stabilizer is optionally used. Specific examples thereof include acid and alkali-soluble materials such as calcium phosphate.

It is preferable to dissolve the dispersant with hydrochloric acid to remove that from the toner particles, followed by washing. In addition, it is possible to remove such a dispersant by decomposing the dispersant using an enzyme.

In addition, known catalysts such as dibutyltin laurate and dioctyltin laurate can be used for the elongation and crosslinking reaction, if desired.

The organic solvent is removed from the dispersion (emulsified slurry). When removed, toner particles are formed. The toner particles are washed, dried and further classified if desired. The toner particles are classified by removing fine particles with a cyclone, a decanter, a centrifugal separator, etc. in the dispersion. Alternatively, the toner particles may be classified as a powder after dried.

The thus prepared dry toner particles can be mixed with one or more other particulate materials such as external additives mentioned above, release agents, charge controlling agents, fluidizers and colorants optionally upon application of mechanical impact thereto to fix the particulate materials on the toner particles.

Specific examples of such mechanical impact application methods include methods in which a mixture is mixed with a highly rotated blade and methods in which a mixture is put into a jet air to collide the particles against each other or a collision plate. Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner of the present invention preferably has the following volume-average particle diameter (Dv), volume-average particle diameter (Dv)/number-average particle diameter (Dn), average circularity, BET specific surface area, penetration, low-temperature fixability, maximum temperature until which the offset occurs and image density of the images produced thereby.

The toner of the present invention preferably has a volume-average particle diameter (Dv) of from 3 to 8 μm, and more preferably from 4 to 7 μm.

When less than 3 μm, the toner is fusion-bonded to the surface of a carrier when used in a two-component developer, resulting in deterioration of the chargeability of the carrier, and filming thereof over a developing roller and fusion bond thereof to a blade forming a thin layer thereof are liable to occur when used as a one-component developer. When greater than 8 μm, the toner is difficult to produce high definition and high-quality images, and largely varies in the particle diameter when the toner is consumed and fed in the developer. The toner of the present invention preferably has a ratio (Dv/Dn) of the volume-average particle diameter (Dv) to a number-average particle diameter (Dn) of from 1.00 to 1.25, and more preferably from 1.10 to 1.25. Such a toner, when used in a two-component developer, has less variation of its particle diameter in the developer even after the toner is consumed and fed for long periods, and has good and stable developability even after stirred in an image developer for long periods. When greater than 1.25, the toner is difficult to produce high definition and high-quality images, and largely varies in the particle diameter when the toner is consumed and fed in the developer.

The (Dv) and the ratio (Dv)/(Dn) can be measured by MULTISIZER II from Beckman Coulter, Inc.

The average circularity is determined by dividing a circumferential length of a circle having an area equivalent to a projected area of the toner with a length of the actual particle, and is preferably from 0.900 to 1.000, and more preferably from 0.910 to 0.995. A ratio of the toner particles having a circularity less than 0.90 is preferably not greater than 30% based on total toner particles.

When less than 0.900, the toner has difficulty in having sufficient transferability and producing high-quality images without a toner dust. When greater than 0.995, an image forming apparatus using blade cleaning has poor cleaning on a photoreceptor and a transfer belt. For example, when images having a large image area such as photo images are produced, untransferred toner occasionally remains on the photoreceptor, resulting in background fouling and contamination of a charging roller.

The average circularity of the toner can be measured by an optical detection method of passing a suspension including a particle through a tabular imaging detector and optically detecting and analyzing the particle image with a CCD camera is suitably used, such as a flow-type particle image analyzer FPIA-2000 from SYSMEX CORPORATION.

The toner of the present invention preferably has a BET specific surface area of from 0.5 to 8.0 $m^2/g$, and more preferably from 0.5 to 7.5 $m^2/g$.

When less than 0.5 $m^2/g$, the particulate resin remaining on the surface of the toner becomes a film over or densely covers the whole surface thereof, and the particulate resin prevents the resin therein from adhering to a fixing paper, resulting in increase of the minimum fixable temperature. When greater than 8.0 $m^2/g$, the particulate resin prevents the wax from exuding from the surface of the toner, resulting in insufficient releasability thereof and offset problems.

The specific surface area thereof can be measured by BET methods such as a BET multipoint method wherein a nitrogen gas is absorbed to the surface of a sample, and the specific surface area thereof is measured by a specific surface area measurer TRISTAR 3000 from Shimadzu Corp.

The penetration is preferably not less than 15 mm, and more preferably from 20 to 30 mm when measured by the method specified in JIS K2235-1991. Specifically, a glass container having a capacity of 50 ml is filled with a toner, and the glass container is left in a constant-temperature bath at 50° C. Then, the toner is cooled to have a room temperature and a penetration test is performed.

When less than 15 mm, the resultant toner has poor thermostable preservability. The larger the penetration, the better the thermostable preservability.

The minimum fixable temperature is preferably less than 140° C. and a temperature at which the offset does not occur is preferably not less than 200° C. to lower the minimum fixable temperature and prevent the offset. The minimum fixable temperature is a temperature of a fixing roller in an image forming apparatus producing images having an image density not less than 70% after scraped with a pad.

The temperature at which the offset does not occur can be measured using an image forming apparatus wherein an image is developed with a predetermined amount of the toner and a fixer can have a variable temperature.

The image density measured by a spectrometer SPECTRODENSITOMETER 938 from X-Rite is preferably not less than 1.40, more preferably not less than 1.45, and even more preferably not less than 1.50. A high-quality image has an image density not less than 1.40.

For example, imagio PRETER 550 from Ricoh Company, Ltd. forms a solid image with a developer in an adhered amount of 1.00±0.01 $mg/cm^2$ on a copy paper TYPE 6200 from Ricoh Company, Ltd. at a surface temperature of 160±2° C. of the fixing roller, and an average of image density of random 6 parts of the solid image, measured by the spectrometer, is determined as the image density.

Colors of the toner of the present invention are not particularly limited, and can be selected from at least one of black, cyan, magenta and yellow.

The toner of the present invention has the glass transition temperatures T1 and T2 and the endothermic quantities Q1 and Q2 at a melting point thereof before and after melting, satisfying the above-mentioned relationships respectively. Therefore, the toner of the present invention has good hot offset resistance, good low-temperature fixability and thermostable preservability, and produces high-quality images.

The developer of the present invention includes at least the toner of the present invention, and optionally other components such as a carrier. The developer may be a one-component developer or a two-component developer, however, the two-component developer having a long life is preferably used in high-speed printers in compliance with the recent high information processing speed.

Even the one-component developer or two-component developer of the present invention has less variation of particle diameter of the toner even after repeatedly used, good and stable developability and produces quality images for long periods without filming over a developing roller and fusion bonding to a member such as a blade forming a thin layer of the toner.

The carrier is not particularly limited, and can be selected in accordance with the purpose, however, preferably includes a core material and a resin layer coating the core material.

The core material is not particularly limited, and can be selected from known materials such as Mn—Sr materials and Mn—Mg materials having 50 to 90 emu/g; and highly magnetized materials such as iron powders having not less than 100 emu/g and magnetite having 75 to 120 emu/g for image density. In addition, light magnetized materials such as Cu—Zn materials having 30 to 80 emu/g are preferably used to decrease a stress to a photoreceptor having toner ears for high-quality images. These can be used alone or in combination.

The core material preferably has a volume-average particle diameter of from 10 to 150 μm, and more preferably from 40 to 100 μm. When less than 10 μm, a magnetization per particle is so low that the carrier scatters. When larger than 150 μm, a specific surface area lowers and the toner occasionally scatters, and a solid image of a full-color image occasionally has poor reproducibility.

The resin coating the core material is not particularly limited, and can be selected in accordance with the purpose. Specific examples of the resin include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins. These can be used alone or in combination.

Specific examples of the amino resins include urea-formaldehyde resins, melamine resins, benzoguanamine resins, urea resins, polyamide resins, epoxy resins, etc. Specific examples of the polyvinyl resins include acrylic resins, polymethylmethacrylate resins, polyacrylonitirile resins, polyvinyl acetate resins, polyvinyl alcohol resins, polyvinyl butyral resins, etc. Specific examples of the polystyrene resins include polystyrene resins, styrene-acrylic copolymers, etc. Specific examples of the halogenated olefin resins include polyvinyl chloride resins, etc. Specific examples of the polyester resins include polyethyleneterephthalate resins, polybutyleneterephthalate resins, etc.

An electroconductive powder may optionally be included in the toner. Specific examples of such electroconductive powders include, but are not limited to, metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The resin layer can be formed by preparing a coating liquid including a solvent and, e.g., the silicone resin; uniformly coating the liquid on the surface of the core material by a known coating method; and drying the liquid and burning the surface thereof. The coating method includes dip coating methods, spray coating methods, brush coating method, etc.

Specific examples of the solvent include, but are not limited to, toluene, xylene, methyl ethyl ketone, methyl isobutyl ketone, cellosolve butyl acetate, etc.

Specific examples of the burning methods include, but are not limited to, externally heating methods or internally heating methods using fixed electric ovens, fluidized electric ovens, rotary electric ovens, burner ovens, microwaves, etc. The carrier preferably includes the resin layer in an amount of from 0.01 to 5.0% by weight. When less than 0.01% by weight, a uniform resin layer cannot be formed on the core material. When greater than 5.0% by weight, the resin layer becomes so thick that carrier particles granulate one another and uniform carrier particles cannot be formed.

The content of the carrier in the two-component developer is not particularly limited, can be selected in accordance with the purpose, and is preferably from 90 to 98% by weight, and more preferably from 90 to 97% by weight.

The developer of the present invention can prevent odor development, has good low temperature fixability and releasability, and can stably produce high-quality images. The developer of the present invention can preferably be used in known electrophotographic image forming methods such as magnetic one-component developing methods, non-magnetic one-component developing methods and two-component developing methods. Particularly, the developer of the present invention can preferably be used in the following toner container, process cartridge, image forming apparatus and image forming method of the present invention.

The toner container of the present invention contains the toner or the developer of the present invention.

The container is not particularly limited, and can be selected from known containers such as a container having a cap. The size, shape, structure, material, etc. thereof are not particularly limited, and can be selected in accordance with the purpose. The container preferably has the shape of a cylinder, and particularly, the cylinder preferably has a spiral concavity and convexity on the inside surface thereof such that a toner can transfer to an exit thereof when the cylinder rotates. In addition, apart or the all of the spiral is preferably a cornice.

The materials for the container are not particularly limited, and resins having good size precision are preferably used, such as polyester resins, polyethylene resins, polypropylene resins, polystyrene resins, polyvinylchloride resins, polyacrylate resins, polycarbonate resins, ABS resins and polyacetal resins.

The toner container of the present invention is easy to store, transport and handle, and is detachable from the process cartridge and the image forming apparatus of the present invention mentioned later, to feed the toner thereto.

The process cartridge of the present invention includes at least an electrostatic latent image bearer bearing an electrostatic latent image and an image developer developing the electrostatic latent image with a developer to form a visible image, and optional other means. The image developer includes at least a developer container containing the toner or developer of the present invention and a developer bearer bearing the toner or developer contained in the container, and further may include a layer thickness regulator regulating a layer thickness of the toner.

The process cartridge of the present invention can be detachable from various electrophotographic image forming apparatuses, and is preferably detachable from the image forming apparatus of the present invention mentioned later.

The image forming method of the present invention includes at least an electrostatic latent image forming process, a development process, a transfer process and a fixing process; and optionally includes other processes such as a discharge process, a cleaning process, a recycle process and a control process.

The image forming apparatus of the present invention includes at least an electrostatic latent image bearer, an electrostatic latent image former, an image developer, a transferer and a fixer, and optionally includes other means such as a discharger, a cleaner, a recycler and a controller.

The material, shape, structure, size, etc. of the electrostatic latent image bearer (so-called a photoconductive insulator or a photoreceptor) are not particularly limited, and can be selected from known electrostatic latent image bearers. However, the electrostatic latent image bearer preferably has the shape of a drum, and the material is preferably an inorganic material such as amorphous silicon and serene, and an organic material such as polysilane and phthalopolymethine. Among these materials, the amorphous silicon having a long life is preferably used.

The electrostatic latent image is formed by uniformly charging the surface of the electrostatic latent image bearer and irradiating imagewise light onto the surface thereof with the electrostatic latent image former.

The electrostatic latent image former includes at least a charger uniformly charging the surface of the electrostatic latent image bearer and an irradiator irradiating imagewise light onto the surface thereof.

The surface of the electrostatic latent image bearer is charged with the charger upon application of voltage.

The charger is not particularly limited, and can be selected in accordance with the purpose, such as an electroconductive or semiconductive rollers, bushes, films, known contact chargers with a rubber blade, and non-contact chargers using a corona discharge such as corotron and scorotron.

The surface of the electrostatic latent image bearer is irradiated with the imagewise light by the irradiator.

The irradiator is not particularly limited, and can be selected in accordance with the purpose, provided that the irradiator can irradiate the surface of the electrostatic latent image bearer with the imagewise light, such as reprographic optical irradiators, rod lens array irradiators, laser optical irradiators and a liquid crystal shutter optical irradiators.

In the present invention, a backside irradiation method irradiating the surface of the electrostatic latent image bearer through the backside thereof may be used.

The visible image is formed by the image developer developing the electrostatic latent image with the toner or developer of the present invention. The image developer is not particularly limited, and can be selected from known image developers, provided that the image developer can develop with the toner or developer of the present invention. For example, an image developer containing the toner or developer of the present invention and being capable of imparting the toner or developer to the electrostatic latent image is preferably used.

The image developer may use a dry developing method or a wet developing method, and may develop a single color or multiple colors. For example, an image developer including a stirrer stirring the toner or developer to be charged and a rotatable magnet roller is preferably used.

In the image developer, the toner and the carrier are mixed and stirred, and the toner is charged and held on the surface of the rotatable magnet roller in the shape of an ear to form a magnetic brush. Since the magnet roller is located close to the electrostatic latent image bearer (photoreceptor), a part of the toner is electrically attracted to the surface thereof. Consequently, the electrostatic latent image is developed with the toner to form a visible image thereon.

The developer contained in the image developer is a developer including the toner of the present invention, and may be a one-component developer or a two-component developer. A toner included therein is the toner of the present invention.

It is preferable that the visible image is firstly transferred onto an intermediate transferer and secondly transferred onto a recording medium thereby. It is more preferable that two or more visible color images are firstly and sequentially transferred onto the intermediate transferer and the resultant complex full-color image is transferred onto the recording medium thereby.

The visible image is transferred by the transferer using a transfer charger charging the electrostatic latent image bearer (photoreceptor). The transferer preferably includes a first transferer transferring the two or more visible color images onto the intermediate transferer and a second transferer transferring the resultant complex full-color image onto the recording medium.

The intermediate transferer is not particularly limited, and can be selected from known transferers in accordance with the purpose, such as a transfer belt.

The transferer may be one, or two or more, and includes a corona transferer using a corona discharge, a transfer belt, a transfer roller, a pressure transfer roller, an adhesive roller, etc.

The recording medium is not particularly limited, and can be selected from known recording media (recording papers).

The visible image transferred onto the recording medium is fixed thereon by a fixer. Each color toner image or the resultant complex full-color image may be fixed thereon.

The fixer is not particularly limited, can be selected in accordance with the purpose, and known heating and pressurizing means are preferably used. The heating and pressurizing means include a combination of a heating roller and a pressure roller, and a combination of a heating roller, a pressure roller and an endless belt, etc. The heating temperature is preferably from 80 to 200° C.

In the present invention, a known optical fixer may be used with or instead of the fixer in accordance with the purpose.

The electrostatic latent image bearer is discharged by the discharger upon application of discharge bias. The discharger is not particularly limited, and can be selected from known dischargers, provide that the discharger can apply the discharge bias to the electrostatic latent image bearer, such as a discharge lamp.

The toner remaining on the electrostatic latent image bearer is preferably removed by the cleaner. The cleaner is not particularly limited, and can be selected from known cleaners, provide that the cleaner can remove the toner remaining thereon, such as a magnetic brush cleaner, an electrostatic brush cleaner, a magnetic roller cleaner, a blade cleaner, a brush cleaner and a web cleaner.

The toner removed by the cleaner is recycled into the image developer with a recycler.

The recycler is not particularly limited, and known transporters can be used.

The controller is not particularly limited, and can be selected in accordance with the purpose, provided the controller can control the above-mentioned means, such as a sequencer and a computer.

FIG. 1 is a schematic view illustrating an embodiment of image forming apparatus using the image forming method of the present invention.

In the image forming apparatus 100 therein, around a photoreceptor drum (hereinafter referred to as a photoreceptor) as an image bearer 10, a charging roller as a charger 20, an irradiator 30, a cleaner having a cleaning blade 60, a discharge lamp as a discharger 70, image developers 45K, 45Y, 45M and 45C and a intermediate transferer 50 are arranged.

The intermediate transferer 50 is suspended by three suspension rollers 51 and endlessly driven by a driver such as motor (not shown) in a direction indicated by an arrow. Some of the suspension rollers 51 are combined with roles of transfer bias rollers feeding a transfer bias to the intermediate transferer and a predetermined transfer bias is applied thereto from an electric source (not shown). A cleaner having a cleaning blade 90 cleaning the intermediate transferer 50 is also arranged. A transfer roller 80 transferring a toner image onto a transfer paper 95 as a final transferer is arranged facing the intermediate transferer 50, to which a transfer bias is applied from an electric source (not shown). Around the intermediate transferer 50, a corona charger 52 is arranged as a charger between a contact point of the photoreceptor 10 and the intermediate transferer 50 and a contact point thereof and a transfer paper 95.

Around the photoreceptor 10, a black image developer 45K, a yellow image developer 45Y, a magenta image developer 45M and a cyan image developer 45C are located facing thereto. The black image developer 45K includes a developer container 42K, a developer feed roller 43K and a developing roller 44K. The yellow image developer 45Y includes a developer container 42Y, a developer feed roller 43Y and a developing roller 44Y. The magenta image developer 45M includes a developer container 42M, a developer feed roller 43M and a developing roller 44M. The cyan image developer 45C includes a developer container 42C, a developer feed roller 43C and a developing roller 44C.

In FIG. 1, after the photoreceptor 10 is uniformly charged rotating in a direction indicated by an arrow, the irradiator 30 irradiates the photoreceptor 10 with an original imagewise light from an optical system (not shown) to form an electrostatic latent image thereon. The electrostatic latent image is developed by the image developers 45K, 45Y, 45M and 45C to form each color toner image thereon. The toner image developed thereby 40 is transferred onto the surface of the intermediate transferer 50 (first transfer), and further transferred onto the transfer paper 95 (second transfer). On the other hand, the toner remaining on the photoreceptor 10 is removed by a cleaner 60, and the photoreceptor 10 is discharged by the discharge lamp. 70 to be ready for the following charge.

Figure 2:
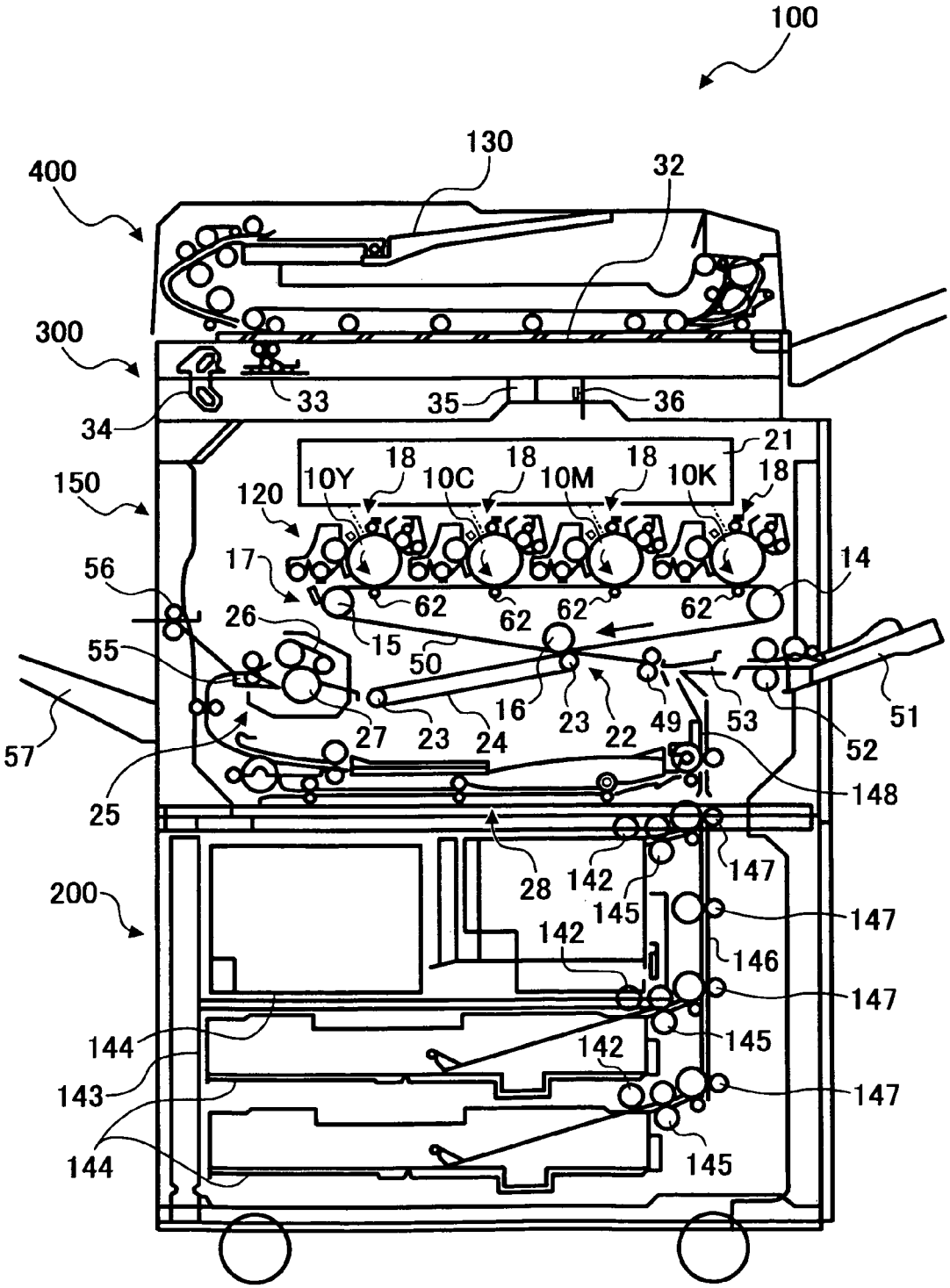
FIG. 2 is schematic view illustrating another embodiment of (tandem color) image forming apparatus using the image forming method of the present invention.
Figure 3:
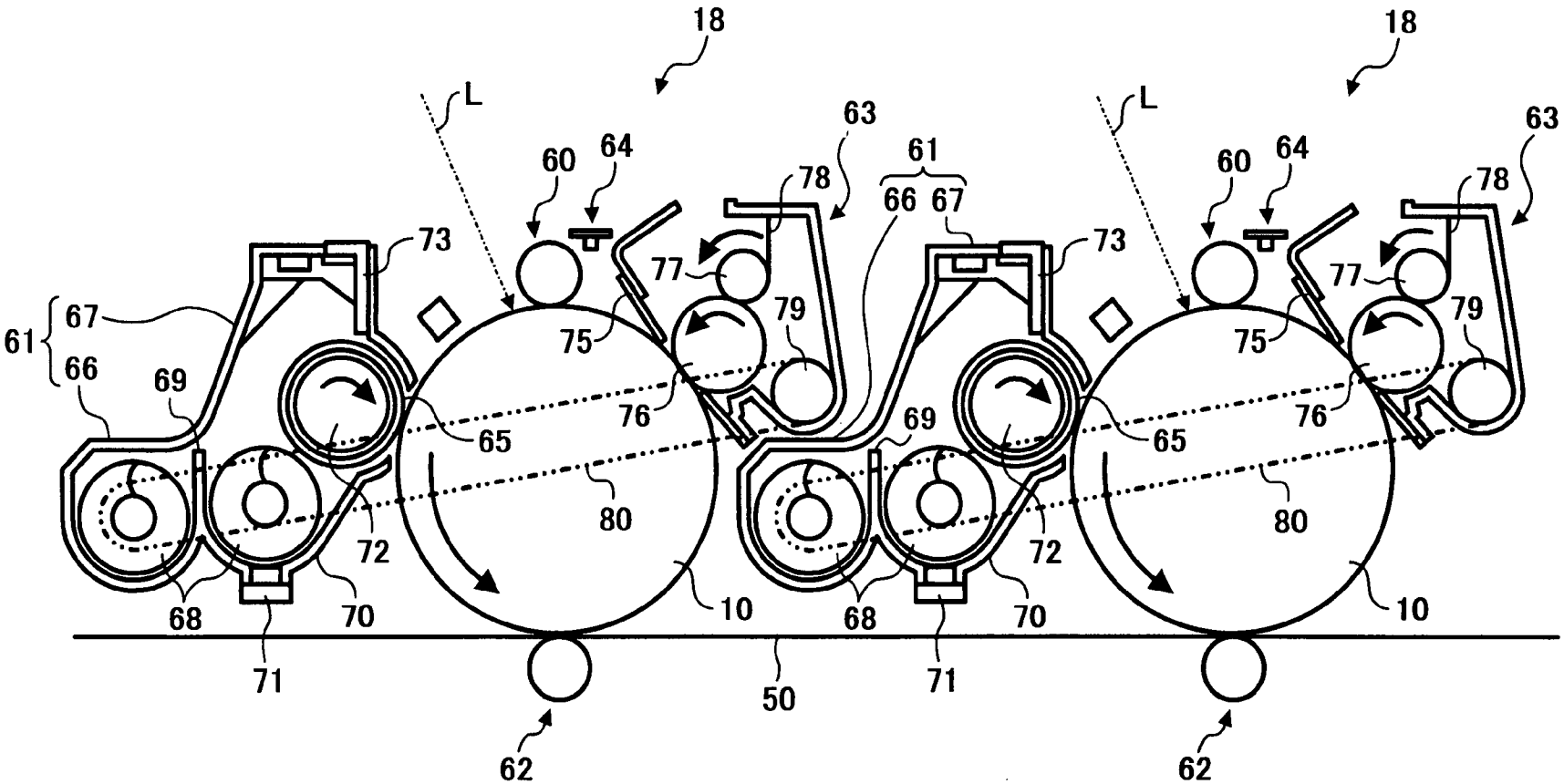
FIG. 3 is schematic view illustrating enlarged view of a part of the image forming apparatus in FIG. 2.

FIG. 2 is schematic view illustrating another embodiment of (tandem color) image forming apparatus using the image forming method of the present invention.

The image forming apparatus 100 therein is a tandem color image forming apparatus including a duplicator 150, a paper feeding table 200, a scanner 300 and an automatic document feeder (ADF) 400.

The duplicator 150 includes an intermediate transferer 50 having the shape of an endless belt.

The intermediate transferer 50 is suspended by three suspension rollers 14, 15 and 16 and rotatable in a clockwise direction. On the left of the suspension roller 15, an intermediate transferer cleaner 17 is located to remove a residual toner on an intermediate transferer 50 after an image is transferred. Above the intermediate transferer 50, four image forming units 18 for yellow, cyan, magenta and black colors are located in line from left to right along a transport direction of the intermediate transferer 50 to form the tandem image forming apparatus 120. Above the tandem color image forming apparatus 120, an irradiator 21 is located. On the opposite side of the tandem color image forming apparatus 120 across the intermediate transferer 50, a second transferer 22 is located. The second transferer 22 includes a an endless second transfer belt 24 and two rollers 23 suspending the endless second transfer belt 24, and is pressed against the suspension roller 16 across the intermediate transferer 50 and transfers an image thereon onto a sheet. Beside the second transferee 22, a fixer 25 fixing a transferred image on the sheet is located. The fixer 25 includes an endless belt 26 and a pressure roller 27 pressed against the belt. Below the second transferer 22 and the fixer 25, a sheet reverser 28 reversing the sheet to form an image on both sides thereof is located in the tandem color image forming apparatus 120.

An original is set on a table 130 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the original.

When a start switch (not shown) is put on, a drive motor (not shown) rotates one of the suspension rollers 14, 15 and 16 such that the other two rollers are driven to rotate, to rotate the intermediate transferer 50. At the same time, each of the image forming units 18 rotates a photoreceptor 10 and forms a single-colored image, i.e., a black image (K), a yellow image (Y), a magenta image (M) and cyan image (C) on each photoreceptor 10K, 10Y, 10M and 10C. The single-colored images are sequentially transferred onto the intermediate transferer 50 to form a full-color image thereon.

On the other hand, when start switch (not shown) is put on, one of paper feeding rollers 142 of paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 to be stopped against a resist roller 49. Alternatively, a paper feeding roller 150 is rotated to take a sheet out of a manual feeding tray 51, and a separation roller 52 separates sheets one by one and feed the sheet into a paper feeding route 53 to be stopped against the resist roller 49. The resist roller 49 is typically earthed, and may be biased to remove a paper dust from the sheet.

Then, in timing with a synthesized full-color image on the intermediate transferer 50, the resist roller 49 is rotated to feed the sheet between the intermediate transferer 50 and the second transferee 22, and the second transferer transfers the full-color image onto the sheet.

The sheet the full-color image is transferred thereon is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

On the other hand, the intermediate transferer 50 after transferring an image is cleaned by the intermediate transferer cleaner 17 to remove a residual toner thereon after the image is transferred, and ready for another image formation by the tandem color image forming apparatus 120.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Resins 1 and 2

In a 5 litter four-opening flask equipped with a nitrogen inlet tube, a dewatering tube, a stirrer and a thermocouple, materials shown in Table 1 were reacted for 5 hrs at 160° C. The mixture was reacted for 1 hr at 200° C. and further reacted at 8.3 KPa for 1 hr to prepare resins 1 and 2.

Synthesis of Resin 3

In a 5 litter four-opening flask equipped with a nitrogen inlet tube, a dewatering tube, a stirrer and a thermocouple, materials shown in Table 1 were reacted for 5 hrs at 160° C., and further reacted for 1 hr at 200° C. to prepare a resin 3.

TABLE 1

| | 1,4-butandiol | 1,6-hexanediol | Fumaric acid | Terephthalic acid | Hydroquinone |
|---|---|---|---|---|---|
| Resin 1 | 38.9 | 5.5 | 55.6 | — | 0.08 |
| Resin 2 | 37.1 | 5.2 | 42.4 | 15.2 | 0.07 |
| Resin 3 | 35.9 | 5.1 | 41.1 | 14.8 | 0.07 |

Synthesis of Resins 4 to 6

In a 5 litter four-opening flask equipped with a nitrogen inlet tube, a dewatering tube, a stirrer and a thermocouple, materials shown in Table 2 besides trimellitic anhydride and 0.1 parts of dibutyltinoxide were reacted for 8 hrs at from 180 to 230° C. After the mixture was further reacted at 8.3 KPa for 1 hr, the trimellitic anhydride was added thereto to be reacted at 220° C. and 40 KPa until having a desired softening point to prepare resins 4 to 6.

TABLE 2

| | BPA = PO | BPA-EO | Ethylene glycol | Neopentyl glycol | Terephthalic acid | Adipic acid | Trimellitic anhydride |
|---|---|---|---|---|---|---|---|
| Resin 4 | — | — | 16.3 | 26.3 | 76.7 | — | 6.9 |
| Resin 5 | — | — | 16.7 | 27.0 | 78.2 | — | 5.1 |
| Resin 6 | 56.1 | 20.0 | — | — | 21.8 | 6.8 | 4.5 |

BPA-PO represents an adduct of bisphenol A with propylene oxide, and BPA-EO represents an adduct of bisphenol A with ethylene oxide.

Synthesis of Resins 7 and 8

In a 5 litter four-opening flask equipped with a nitrogen inlet tube, a dewatering tube, a stirrer and a thermocouple, materials shown in Table 3 besides trimellitic anhydride and 0.1 parts of dibutyltinoxide were reacted for 8 hrs at 225° C. After the mixture was further reacted at 8.3 KPa for 1 hr, the trimellitic anhydride was added thereto at 210° C. and the mixture was reacted until having a desired softening point to prepare resins 7 and 8.

TABLE 3

| | BPA-PO | BPA-EO | Terephthalic acid | Dodecenyl succinic anhydride | Trimellitic anhydride |
|---|---|---|---|---|---|
| Resin 7 | 47.0 | 18.6 | 12.7 | 13.6 | 8.1 |
| Resin 8 | 45.7 | 18.2 | 15.1 | 12.2 | 8.8 |

BPA-PO represents an adduct of bisphenol A with propylene oxide, and BPA-EO represents an adduct of bisphenol A with ethylene oxide.

The endothermic peak temperature when measured by a differential scanning calorimeter (DSC), Mw, Mn, Mw/Mn based on the orthodichlorobenzene-soluble components measured by GPC and an absorption due to the δ CH (i.e., out-of-plane angle-changing vibration) of an olefin in infrared absorption spectrum were measured on the crystalline resins 1 to 3. The results are shown in Table 4.

TABLE 4

| | DSC endothermic Peak temperature (° C.) | Mw | Mn | Mw/Mn | δCH ($cm^{-1}$) |
|---|---|---|---|---|---|
| Resin 1 | 125 | 3,500 | 900 | 3.9 | 970 |
| Resin 2 | 98 | 1,500 | 800 | 1.8 | 968 |
| Resin 3 | 51 | 6,700 | 2,500 | 2.7 | — |

Example 1

40 parts of carbon black REGAL 400R from Cabot Corp., 60 parts of a binder resin, i.e., a polyester resin RS-801 having an acid value of 10, a Mw of 20,000 and a glass transition temperature (Tg) of 64° C. from Sanyo Chemical industries, Ltd. and 30 parts of water were mixed by a HENSCHEL MIXER from Mitsui Mining Co., Ltd. to prepare a water-logged pigment agglomerate. This was kneaded by a two-roll mil having a surface temperature of 130° C. for 45 min, extended upon application of pressure, cooled and pulverized by a pulverizer from HOSOKAWAMICRON CORPORATION to prepare a master batch having a particle diameter of 1 mm.

440 parts of the resin 1, 194 parts of the resin 4, 110 parts of carnauba wax and 1,806 parts of ethyl acetate were mixed in a reaction vessel including a stirrer and a thermometer. The mixture was heated to have a temperature of 80° C. while stirred. After the temperature of 8° C. was maintained for 5 hrs, the mixture was cooled to have a temperature of 30° C. in an hour. Then, 495 parts of the master batch and 495 parts of ethyl acetate were added to the mixture and mixed for 1 hr to prepare a material solution.

1,324 parts of the material solution were transferred into another vessel, and the carbon black and wax therein were dispersed by a beads mill (Ultra Visco Mill from IMECS CO., LTD.) for 3 passes under the following conditions:

liquid feeding speed of 1 kg/hr peripheral disc speed of 6 m/sec, and filling zirconia beads having diameter 0.5 mm for 80% by volume.

Next, 1,324 parts of an ethyl acetate solution of the resin 4 having a concentration of 65% were added to the material solution 1 and the mixture was stirred by the beads mill for one pass under the same conditions to prepare an organic solution. The organic solution had a solid content having a concentration of 50% (130° C. and 30 min).

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 7 hrs at a normal pressure and 230° C. Further, after the mixture was depressurized to 10 to 15 mm Hg and reacted for 5 hrs to prepare an intermediate polyester. The intermediate polyester had a number-average molecular weight of 2,100, a weight-average molecular weight of 9,500, a Tg of 55° C. and an acid value of 0.5 and a hydroxyl value of 49.

Next, 411 parts of the intermediate polyester, 89 parts of isophoronediisocyanate and 500 parts of ethyl acetate were reacted in a reactor vessel including a cooling pipe, a stirrer and a nitrogen inlet pipe for 5 hrs at 100° C. to prepare a prepolymer (the polymer capable of reacting with the compound having a group including an active hydrogen).

The prepolymer included a free isocyanate in an amount of 1.53% by weight.

170 parts of isophorondiamine and 75 parts of methyl ethyl ketone were reacted at 50° C. for 5 hrs in a reaction vessel including a stirrer and a thermometer to prepare a ketimine compound (the compound having a group including an active hydrogen).

The ketimine compound had an amine value of 418.

716 of the organic solution, 86 of the prepolymer and 3.7 parts of the ketimine compound were mixed in a vessel by a TK-type homomixer from Tokushu Kika Kogyo Co., Ltd. at 5,000 rpm for 1 min to prepare a toner material solution or dispersion. 683 parts of water, 11 parts of a sodium salt of an adduct of a sulfuric ester with ethyleneoxide methacrylate (ELEMINOL RS-30 from Sanyo Chemical Industries, Ltd.), 79 parts of styrene, 79 parts of methacrylic acid, 105 parts of butylacrylate, 13 parts of divinylbenzene and 1 part of persulfate ammonium were mixed in a reactor vessel including a stirrer and a thermometer, and the mixture was stirred for 15 min at 400 rpm to prepare a white emulsion. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare a particulate vinyl resin dispersion (a copolymer of a sodium salt of an adduct of styrene-methacrylate-butylacrylate-sulfuric ester with ethyleneoxide methacrylate).

The particulate vinyl resin dispersion was measured by LA-920 to find a volume-average particle diameter thereof was 105 nm. A part of thereof was dried to isolate a resin component therefrom. The resin component had a Tg of 95° C., Mw of 980,000 and Mv of 140,000.

990 parts of water, 80 parts of the particulate vinyl resin dispersion, 40 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid, i.e., an aqueous medium.

809 parts of the toner material solution or dispersion and 1,200 parts of the aqueous medium were mixed by the TK-type homomixer at 13,000 rpm for 20 min to prepare a dispersion (an emulsified slurry).

The dispersion was put in a vessel including a stirrer and a thermometer, a solvent was removed therefrom at 30° C. for 8 hrs and the slurry was aged at 45° C. for 4 hrs to prepare a dispersion slurry.

The dispersion slurry had a volume-average particle diameter of 5.7 μm and a number-average particle diameter of 5.0 μm when measure by MULTISIZER II from Beckman Coulter, Inc.

After 100 parts of the dispersion slurry was filtered under reduced pressure, 300 parts of ion-exchange water were added thereto and mixed by the TK-type homomixer at 12,000 rpm for 10 min, and the mixture was filtered. This operation was repeated for 3 times to prepare a final filtered cake.

The final filtered cake was dried by an air drier at 45° C. for 48 hrs and sieved by a mesh having an opening of 75 μm to prepare a host toner.

100 parts of the host toner, 1.0 parts of hydrophobic silica and 0.5 parts of titanium oxide as external additives were mixed by HENSCHEL MIXER from Mitsui Mining Co., Ltd. to prepare a toner.

Example 2

The procedure for preparation of the toner in Example 1 was repeated to prepare a toner except for replacing the resin 4 with the resin 5.

Example 3

The procedure for preparation of the toner in Example 1 was repeated to prepare a toner except for replacing the resin 1 with the resin 2.

Example 4

The procedure for preparation of the toner in Example 1 was repeated to prepare a toner except for replacing the resin 1 with the resin 2, and the resin 4 with the resin 5 respectively.

Example 5

The procedure for preparation of the toner in Example 1 was repeated to prepare a toner except for replacing the resin 4 with the resin 3.

Comparative Example 1

The procedure for preparation of the toner in Example 1 was repeated to prepare a toner except for replacing the resin 4 with the resin 7.

Comparative Example 2

The procedure for preparation of the toner in Example 1 was repeated to prepare a toner except for replacing the resin 4 with the resin 8.

Comparative Example 3

The procedure for preparation of the toner in Example 1 was repeated to prepare a toner except for replacing the resin 1 with the resin 3.

Tg (T1) of the toners prepared in Examples 1 to 5 and Comparative Examples 1 to 3 and an endothermic quantity (Q1) at a melting point (Tm) thereof before melting when heated from −20° C. to 150° C. at a heating speed of 10° C./min, and Tg (T2) thereof and an endothermic quantity (Q2) at a melting point thereof after melting after heated from −20° C. to 150° C. at a heating speed of 10° C./min, cooled to −20° C. at a cooling speed of 10° C./min and heated again at a heating speed of 10° C./min are shown in Table 5.

TABLE 5

| | Before melting | | | After melting | | T1 − | |
|---|---|---|---|---|---|---|---|
| | T1(° C.) | Tm(° C.) | Q1(J/g) | T2(° C.) | Q2(J/g) | T2 (° C.) | Q1/Q2 |
| Example 1 | 66.5 | 125 | 15.3 | 40.2 | 0.5 | 26.3 | 0.03 |
| Example 2 | 61 | 125 | 15.3 | 37.8 | 1.4 | 23.2 | 0.09 |
| Example 3 | 66.5 | 98 | 12.6 | 34 | 1.4 | 32.5 | 0.10 |
| Example 4 | 61 | 98 | 12.6 | 13.1 | 0 | 47.9 | 0 |
| Example 5 | 43 | 125 | 15.3 | 17 | 0.8 | 26 | 0.05 |
| Comparative Example 1 | 60.8 | 125 | 15.3 | 52.4 | 12.8 | 8.4 | 0.84 |
| Comparative Example 2 | 58.3 | 125 | 15.3 | 50.3 | 13.1 | 8 | 0.86 |
| Comparative Example 3 | 43 | 51 | 2.5 | 35 | 2.2 | 8 | 0.88 |

In addition, Dv, Dn, Dv/Dn, an average circularity, a coverage of the particulate resin, a residual ratio thereof and a specific surface area measured by BET method of each of the toners are shown in Table 6.

As for the coverage of the particulate resin, from several electron microscopic pictures of the surface of the toner at a magnification of 50,000 times, a picture thereof having less slopes and cracks are selected, and the coverage of the particulate resin thereof was measured using an image analyzer LUZEX III from Nireco Corp.

The residual ratio thereof was measured using a pyrolysis gas chromatographic mass spectrometer QR-5000 from Shimadzu Corp.

TABLE 6

| | Dv (μm) | Dn (μm) | Dv/Dn | Average circularity | Coverage (%) | Residual ratio (% by weight) | BET specific surface area |
|---|---|---|---|---|---|---|---|
| Example 1 | 5.3 | 4.65 | 1.14 | 0.98 | 85 | 3.8 | 1.8 |
| Example 2 | 5.07 | 4.5 | 1.13 | 0.98 | 95 | 4.1 | 2.5 |
| Example 3 | 5.3 | 4.68 | 1.13 | 0.97 | 77 | 1.8 | 1.7 |
| Example 4 | 4.8 | 4.17 | 1.15 | 0.98 | 100 | 4.5 | 2.0 |

TABLE 6-continued

| | Dv (μm) | Dn (μm) | Dv/Dn | Average circularity | Coverage (%) | Residual ratio (% by weight) | BET specific surface area |
|---|---|---|---|---|---|---|---|
| Example 5 | 5.03 | 4.52 | 1.11 | 0.97 | 92 | 4.3 | 1.5 |
| Comparative Example 1 | 5.6 | 5.0 | 1.12 | 0.97 | 93 | 3.4 | 1.5 |
| Comparative Example 2 | 5.2 | 4.52 | 1.15 | 0.95 | 87 | 2.4 | 1.7 |
| Comparative Example 3 | 4.78 | 4.23 | 1.13 | 0.97 | 84 | 4.5 | 2.3 |

5% by weight of each toner and 95% by weight of copper-zinc ferrite carrier coated with a silicone resin having an average of 40 μm were mixed by a conventional method to prepare developers including each toner.

The fixability (a fixable temperature at which offset does not occur and a minimum fixable temperature), thermostable preservability and overall performance of each of the developers was evaluated as follows. The results are shown in Table 7.

Figure 4:
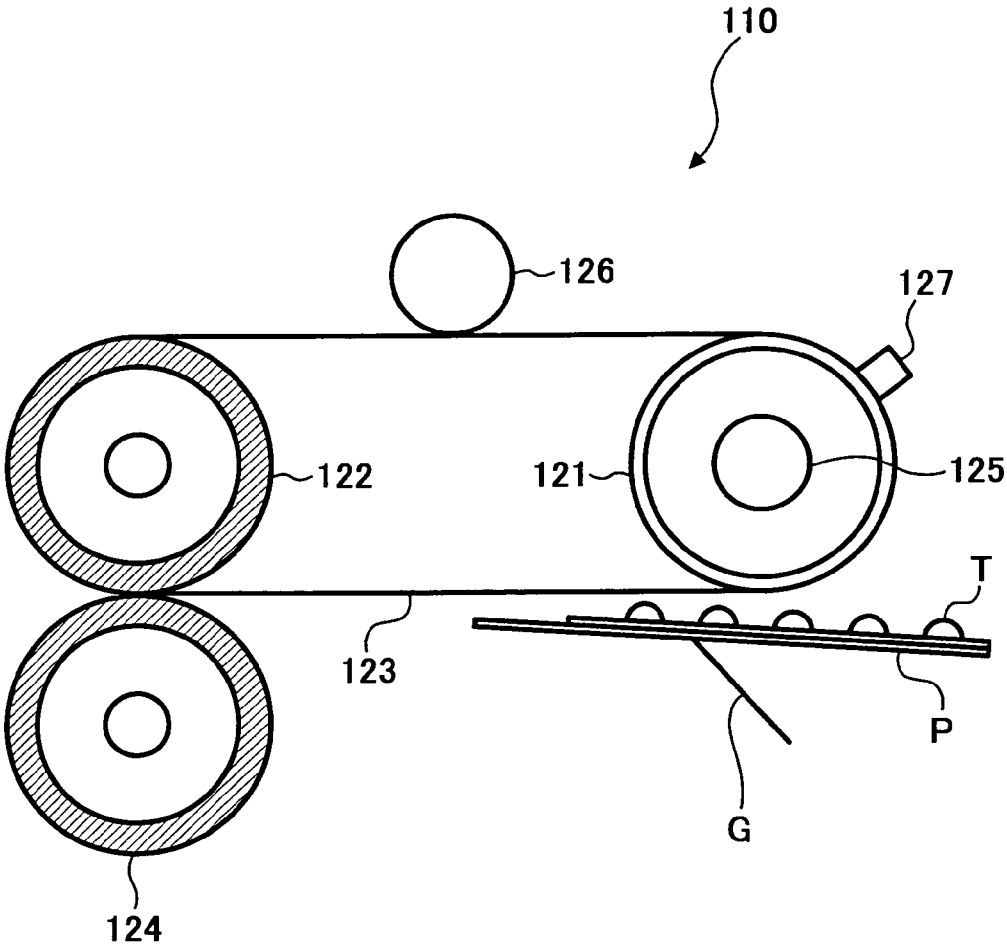
FIG. 4 is schematic view illustrating a fixer using a belt for use in an embodiment of image forming apparatus using the image forming method of the present invention.

The fixability (a fixable temperature at which offset does not occur and a minimum fixable temperature) was evaluated using an image forming apparatus including a belt fixer 110 in FIG. 4.

The belt fixer 110 includes a heat roller 121, a fixing roller 122, a pressure roller 124 and a fixing belt 123.

The fixing belt 123 is extended and suspended by the heat roller 121 and the fixing roller 122 located rotatable inside, and is heated by the heat roller 121 to have a predetermined temperature. The heat roller 121 includes a heat source 125 and a temperature sensor 127 located close to the heat roller 121 controls the temperature. The fixing roller 122 is located rotatable inside of fixing belt 123 while contacting thereto. The pressure roller 124 is located rotatable outside of the fixing belt 123 while contacting thereto so as to pressurize the fixing roller 122.

First, a recording medium (sheet) P a toner image to be fixed on is formed on is transported to the heat roller 121. A toner T on the sheet P is heated and melted with the heat roller 121 and fixing belt 123 heated by the heat source 125. The sheet P is inserted into a nip formed by the fixing roller 122 and the pressure roller 124. The sheet p is contacted to the surface of the fixing belt 113 rotating in conjunction with the rotation of the fixing roller 122 and pressure roller 124, and is pressurized by the pressure roller 124 when passing through the nip such that the toner T is fixed on the sheet P. The sheet P the toner T is fixed on passes the fixing roller 122 and the pressure roller 124, and leaves from the fixing belt 123 and is transported to a tray (not shown) through a guide G. The fixing belt 123 is cleaned by a cleaning roller 126.

The belt tension was 1.5 kg/side, the belt speed was 170 mm/sec and the nip width was 10 mm.

The fixing roller 122 is a silicone foamed roller having a diameter of 38 mm and an ASKER C hardness about 30°. The pressure roller 124 is a roller having a diameter of 50 mm and an ASKER C hardness about 75° formed of a metallic (iron) shaft having a diameter of 48 mm and a thickness of 1 mm coated with a PFA layer coated with a silicone rubber layer having a thickness of 1 mm. The heat roller is an aluminum roller having a diameter of 30 mm and a thickness of 2 mm. The fixing belt 123 is formed of a nickel belt substrate coated with s silicone rubber release layer having a thickness about 150 μm, having a diameter of 60 mm and a width of 310 mm, and is extended and suspended by the heat roller 121 and the fixing roller 122.

PRETER 550 from Ricoh Company, Ltd. equipped with the belt fixer in FIG. 4 was controlled to produce a solid toner image including a toner of 1.0±0.1 mg/cm$^2$ of each mono-color image and a red image, a blue image and a green image as a neutral color image on a transfer paper TYPE 6300 from Ricoh Company, Ltd. The solid toner image was fixed thereon, changing the temperature of the fixing belt (heat roller) to find the fixable temperature at which offset does not occur.

The fixing roll temperature at which a fixed image had an image density not less than 70% after scraped with a pad was determined as the minimum fixable temperature. In addition, the low-temperature fixability was evaluated based on the following standard.

◎: less than 100° C.
○: not less than 100° C. less than 110° C.
Δ: not less than 110° C. less than 120° C.
X: not less than 120° C.

The penetration was measured by a method based on JIS K-2235-1991 and the thermostable preservability was evaluated based on the following standard. The larger the penetration, the better the thermostable preservability.

◎: not less than 20 mm
○: not less than 15 mm less than 20 mm
Δ: not less than 10 mm less than 15 mm
X: less than 10 mm From the results of the above-mentioned evaluations, the overall performance was evaluated as follows.

◎: Very good
○: good
Δ: average
X: poor

TABLE 7

| | Fixable temperature W/O offset (° C.) | Minimum fixable temperature (° C.) | Low-temperature fixability | Thermostable preservability | overall |
|---|---|---|---|---|---|
| Example 1 | 210 | 105 | ○ | ◎ | ○ |
| Example 2 | 210 | 100 | ○ | ◎ | ○ |
| Example 3 | 210 | 95 | ◎ | ◎ | ◎ |

TABLE 7-continued

| | Fixable temperature W/O offset (° C.) | Minimum fixable temperature (° C.) | Low-temperature fixability | Thermostable preservability | overall |
|---|---|---|---|---|---|
| Example 4 | 200 | 90 | ◎ | ◎ | ◎ |
| Example 5 | 205 | 95 | ◎ | Δ | Δ |
| Comparative Example 1 | 210 | 130 | X | ◎ | X |
| Comparative Example 2 | 210 | 130 | X | ○ | X |
| Comparative Example 3 | 200 | 120 | X | Δ | X |

The toners prepared in Examples 1 to 5 typically had good low-temperature fixability and thermostable preservability. Particularly, the toners prepared in Examples 3 to 5 had good low-temperature fixability and the toners prepared in Examples 1 to 4 had good thermostable preservability. Although the toners prepared in Comparative Examples 1 to 3 had good thermostable preservability, they had poor low-temperature fixability. Therefore, the overall evaluations thereof were poor.

This application claims priority and contains subject matter related to Japanese Patent Application No. 2004-269026 filed on Sep. 15, 2004, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

binder resins, including a crystalline polyester resin and an amorphous polyester resin; and a colorant;

wherein:

the toner is prepared by a method, comprising:

dissolving or dispersing at least the binder resins and the colorant in a solvent to prepare a toner constituent liquid;

emulsifying or dispersing the toner constituent liquid in an aqueous medium comprising a particulate resin to granulate; and removing the solvent;

the toner comprises from 1 to 30% by weight of the crystalline polyester resin based on a total weight of the binder resins;

the toner has a circularity of from 0.97 to 0.995; and the toner satisfies the following relationships:

$$40° \text{ C.} < T1 < 80° \text{ C.; and}$$

$$10° \text{ C.} < (T1 - T2) < 47.9° \text{ C.;}$$

wherein T1 represents a glass transition temperature of the toner before melting when heated from −20° C. to 150° C. at a heating speed of 10° C./min, and T2 represents a glass transition temperature of the toner after melting after being heated from −20° C. to 150° C. at a heating speed of 10° C./min, cooled to −20° C. at a cooling speed of 10° C./min and heated again at a heating speed of 10° C./min.

2. The toner of claim 1, wherein the crystalline polyester resin has an endothermic peak temperature of from 50 to 150° C. when measured by a differential scanning calorimeter.

3. The toner of claim 1, wherein the crystalline polyester resin has orthodichlorobenzene soluble components having a weight-average molecular weight (Mw) of from 1,000 to 30,000, a number-average molecular weight (Mn) of from 500 to 6,000 and a ratio (Mw/Mn) of the weight-average molecular weight (Mw) to the number-average molecular weight (Mn) of from 2 to 8 when measured by a gel permeation chromatography.

4. The toner of claim 1, wherein the crystalline polyester has the following formula (1):

$$[—O—OO—(CR_1—CR_2)_L—OO—O—(CH_2)_n—]_m \quad (1)$$

wherein R1 and R2 independently represent a hydrogen atom or a hydrocarbon group, L represents an integer of from 1 to 3, and n and m represent repeat unit numbers.

5. The toner of claim 1, wherein the crystalline polyester has an infrared absorption spectrum such that an absorption due to the δ CH (i.e., out-of-plane angle-changing vibration) of an olefin is observed at 965±10 $cm^{-1}$ or 990±10 $cm^{-1}$.

6. The toner of claim 1, wherein the toner has a volume-average particle diameter (Dv) of from 3 to 8 μm, and a ratio (Dv/Dn) of the volume-average particle diameter (Dv) to a number-average particle diameter (Dn) of the toner of from 1.00 to 1.25.

7. The toner of claim 1, wherein the T1 is higher than 45° C. and lower than 80° C.

8. The toner of claim 1, wherein the melting point is higher than 50° C. and lower than 150° C.

9. The toner of claim 1, wherein the melting point is higher than T1.

10. The toner of claim 1, wherein the Q1 is larger than 2 J/g and less than 30 J/g.

11. An image forming method comprising:

forming an electrostatic latent image on an electrostatic latent image bearer;

developing the electrostatic latent image with the toner according to claim 1 to form a toner image thereon;

transferring the toner image onto a recording medium; and fixing the toner image thereon.

12. The toner of claim 1, wherein the toner satisfies the following relationship:

$$0 < Q2/Q1 < 2/3$$

wherein Q1 represents an endothermic quantity at a melting point of the toner before melting when heated from −20° C. to 150° C. at a heating speed of 10° C./min, and Q2 represents a an endothermic quantity at a melting point of the toner after melting after being heated from −20° C. to 150° C. at a heating speed of 10° C./min, cooled to −20° C. at a cooling speed of 10° C./min and heated again at a heating speed of 10° C./min.

13. The toner of claim 1, wherein the crystalline polyester resin and the amorphous polyester resin are at least partially compatible with each other.

* * * * *